US006229130B1

(12) United States Patent
Furuta et al.

(10) Patent No.: US 6,229,130 B1
(45) Date of Patent: May 8, 2001

(54) HEATING APPARATUS FOR COOKING

(75) Inventors: Kazuhiro Furuta; Hidenori Kako, both of Seto; Toshio Kakizawa, Kuwana, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/637,947

(22) Filed: Aug. 11, 2000

(30) Foreign Application Priority Data

Aug. 12, 1999 (JP) ..... 11-228841

(51) Int. Cl.[7] ..... H05B 6/68

(52) U.S. Cl. ..... 219/711; 219/494; 99/325; 374/149

(58) Field of Search ..... 219/711, 710, 219/494, 510; 374/149, 121, 126, 129, 130, 131, 133; 99/325

(56) References Cited

U.S. PATENT DOCUMENTS 5,693,247 * 12/1997 Bu et al. ..... 219/711

6,121,596 * 9/2000 Taino et al. ..... 219/711

FOREIGN PATENT DOCUMENTS 57-52724 * 3/1982 (JP) ..... 219/711

61-250422 * 11/1986 (JP) ..... 219/711

* cited by examiner

*Primary Examiner*—Philip H. Leung

(74) *Attorney, Agent, or Firm*—Pillsbury Winthrop LLP

(57) ABSTRACT

A detection target judgment section (12) in a heating apparatus for cooking judges a type of each detection area. The type is selected in three types of detection areas: A direct detection area where only a target food (9) is detected; A boundary detection area where both a part of the target food (9) and a background are detected simultaneously; and a background detection area where only the background is detected. The heating process control section (13) preciously calculates a temperature of each part in the target food (9) based on the temperature in each of the above detection areas calculated by a temperature calculation section (11) in order to control a thawing and heating process for the target food (9).

24 Claims, 24 Drawing Sheets

HEATING CONTROL SECTION

HEATING CONTROL SECTION 82
83
THERMOPILE
84
AMPLIFIER
85
MULTIPLEXER
PC
P8
P7
P6
P5
P4
P3
P2
P1
(PQ)
MUX
VSS
VDD
Vc
A OUT
Sample
811
S&H
810
MUX
Tc1-8
(Tbb1-8)
86
89
88
Tam
VDD
VSS
87
812
RCO
813
CONTROL UNIT
Takt
Reset
CH1
CE
Thermopile
Line
SENSOR CIRCUIT SECTION

LENS 81
8
SENSOR
CIRCUIT
SECTION 82

SENSOR
CIRCUIT
SECTION 82

HEATING APPARATUS FOR COOKING

CROSS-REFERENCE TO RELATED APPLICATION

This application is based upon and claims the benefit of priority from the prior Japanese Patent Application No. 11-184162, filed Jun. 29, 1999; the entire contents of which are incorporated herein by reference.

BACKGROUND OF THE INVENTION

1. Field of the Invention

The present invention relates to a heating apparatus for cooking such as microwave ovens in which a frozen food (as a target food item to be cooked) placed on a turntable in a cavity as a heating chamber is thawed and heated by irradiating a microwave of a high frequency to the food item.

2. Description of the Related Art

In many conventional heating apparatus for cooking such as microwave ovens to control a heating process by detecting a temperature of a target food to be heated by using an infrared ray (IR) sensor of a non-contact type, it is impossible to accurately detect a temperature of an area which is smaller in size than the detection field of the IR sensor (or the field of view of the IR sensor), because the detection field of the IR sensor is so elliptical in shape that the IR sensor outputs the average value of a temperature distribution in the detection field of the IR sensor.

For example, when the detection field of the IR sensor overlaps only with a boundary area (or the end part) of a target food to be detected, in other words, when a part in the detection field of the IR sensor overlaps with the boundary area of the food, the temperatures of both the target food and a background area in which there is no target food are averaged. In this case, it is impossible to obtain an accurate temperature of the food. In order to avoid this conventional drawback, when the detection field of the IR sensor is set to narrow, the resolution of the IR sensor becomes high and the occurrence that the detection field of the IR sensor overlaps with the boundary area of the food can be small, but it is impossible to avoid any occurrence that the detection field of the IR sensor overlaps with the boundary area of the food completely. Thus, even if the detection field of the IR sensor is set to narrow, the detected temperature in the above case also has an inaccurate value. In addition, to narrow the detection field of the IR sensor greatly causes to decrease the sensitivity of the IR sensor and to decrease the function of noise immunity, so that the accuracy of the detection by the IR sensor becomes low.

If the number of IR elements forming the IR sensor is only one, it is impossible to set the detection field of the IR sensor into a narrow area because it is necessary to keep a widely detectable area in a heating chamber of the heating apparatus for cooking.

Furthermore, even if the IR sensor comprises a plurality of the IR elements in order to detect a plurality of detection areas in the heating chamber in the heating apparatus for cooking, it is possible to set the detection field of each IR element to narrow, but, there still remains the drawback that it is impossible to detect: the temperature of the boundary area (or the end part) of the target food accurately.

During a thawing process in practical cooking, for example, the temperature of a localized area becomes increased by uneven cooking of the target food, uneven heating of the target food, and the like, the part of the target food becomes a half cooked state (namely, a half-boiled state) or a boiled state. This case often occurs at a boundary area of the target food. The conventional heating apparatus for cooking such as microwave ovens cannot solve this drawback because the conventional heating apparatus for cooking cannot detect accurately the increasing of the temperature of the boundary area of the target food, so that it cannot prevent: to cause the half-cooking state or the uneven state of the target food.

SUMMARY OF THE INVENTION

Accordingly, an object of the present invention is, with due consideration to the drawbacks of the conventional technique, to provide a heating apparatus for cooking such as microwave ovens that is capable of accurately detecting a temperature of a boundary area of (such as the end part of) a target food to be cooked placed on a turntable in a heating chamber (or a cavity). That is to say, an object of the present invention is to provide the heating apparatus for cooking that is capable of accurately detecting the temperature of the boundary area (such as the end part of the target food) of the target food even if one detection field of an IR sensor simultaneously covers both the boundary area of the target food and the background area where no target food is placed. More concretely, although the temperature of the detection field where both the part of the target food and the background are detected simultaneously is changed in general according to the ratio of both the areas of the part of the target food and the background, an object of the present invention is to provide the heating apparatus for cooking that is capable of accurately calculating the temperature of the target food to be cooked by detecting the temperature of the background and the ratio between the target food and the background in a boundary detection field of the IR sensor.

In accordance with a preferred embodiment of the present invention, a heating apparatus for cooking comprises a heating chamber, heating means, infrared ray (IR) detection means, temperature calculation means, heating process control means, and detection target judgment means. In the heating chamber, a target food to be cooked is placed and then heated. The heating means irradiates a microwave on the target food. The infrared ray (IR) detection means having a plurality of detection elements for detecting a plurality of detection areas in the heating chamber by a non-contact manner. The temperature calculation means calculates temperatures of the plurality of detection areas based on the detection results obtained by the IR detection means. The heating process control means controls a heating process for the target food based on calculation results obtained by the temperature calculation means. The detection target judgment means judges a type of each detection area in the heating chamber corresponding to each of the plurality of detection elements based on a detected initial temperature distribution of the heating chamber. There are following three types as the type of the detection area: a direct detection area where there is only a part or entire of the target food and the target food is directly detected; a boundary detection area where there are both a part or entire of the target food and a background simultaneously; and a background area where there is no target food. In the heating apparatus for cooking according to the present invention, then heating process control means controls the heating process based on the detection results obtained by the detection target judgment means.

The heating apparatus for cooking as another preferred embodiment of the present invention further comprises background temperature detection means for detecting a temperature of the background in the heating chamber during the cooking of the target food, and temperature calculation means for the target food for calculating a calculation temperature of the target food based on temperatures detected in the direct detection area where only the target food is directly detected and for calculating a calculation temperature of each part in the target food in the boundary detection field where both the part of the target food and the background are detected simultaneously.

In the heating apparatus for cooking as another preferred embodiment of the present invention, the detection target judgment means detects the initial temperature distribution of the heating chamber, and judges the type of the detection field detected by each detection element in the IR detection means. The type is selected in the three cases: The direct detection field where only the target food is detected; The boundary detection field where both the part of the target food and the background are detected simultaneously; and The background detection field where no target food is detected. The heating process control means then controls the heating process for the target food based on the result of the judgment transferred from the detection target judgment means.

In the heating apparatus for cooking as another preferred embodiment of the present invention, the background temperature detection means calculates the temperature of the background based on a detection result obtained by a self-temperature detection means for detecting a self-temperature incorporated in the IR detection means.

In the heating apparatus for cooking as another preferred embodiment of the present invention, the background temperature detection means calculates the temperature of the background based on a detection result of a temperature detection means for detecting an internal temperature of the heating chamber that is additionally incorporated in the heating chamber.

In the heating apparatus for cooking as another preferred embodiment of the present invention, the background temperature detection means sets one or more of the plurality of detection elements in the IR detection means as an element for detecting a temperature of an area other than a tray on which the target food is placed in the heating chamber, and calculates the temperature of the background based on the temperature obtained by the one or more of the plurality of detection elements.

In the heating apparatus for cooking as another preferred embodiment of the present invention, the background temperature detection means calculates the temperature of the background based on the maximum value in the temperature values detected at the most outer periphery of a tray, on which the target food is placed, in the detection ranges in the heating chamber detected by the plurality of detection elements.

In the heating apparatus for cooking as another preferred embodiment of the present invention, the background temperature detection means calculates the temperature of the background based on a detected internal temperature value of the heating chamber detected by the temperature detection means for detecting the internal temperature of the heating chamber when a door of the heating chamber is open.

In the heating apparatus for cooking as another preferred embodiment of the present invention, the temperature calculation means calculates an initial temperature distribution of the heating chamber and calculates an initial temperature of the target food based on a minimum temperature value in the initial temperature distribution in the heating chamber.

The heating apparatus for cooking as another preferred embodiment of the present invention further comprises boundary detection area judgment means for judging the boundary detection area based on an intermediate value between the calculated temperature of the target food and the calculated temperature of the background according to the initial temperature distribution in the heating chamber calculated by the temperature calculation means.

The heating apparatus for cooking as another preferred embodiment of the present invention further comprises detection rate judgment means for judging a ratio or a range of the target food in the boundary detection area, where both the target food and the background are detected simultaneously, based on the calculated temperature of the target food, the calculated temperature of the background, and the initial temperature distribution in the heating chamber calculated by the temperature calculation means.

In the heating apparatus for cooking as another preferred embodiment of the present invention, the detection rate judgment means performs the temperature detection and judgment operation plural times.

The heating apparatus for cooking as another preferred embodiment of the present invention further comprises boundary target food temperature calculation means for compensating the calculated temperature value in a boundary detection area where both the target food and the background are detected simultaneously based on the judgment result of the detection rate judgment means, and for calculating the temperature of a part in the target food in the boundary detection area.

In the heating apparatus for cooking as another preferred embodiment of the present invention, the heating process control means judges a rank of the ratio or the range of the target food in the boundary detection area, where both the target food and the background are detected simultaneously, obtained by the detection rate judgment means, and wherein the rank is selected in a plurality of ranks that are classified and set in advance corresponding to different heating processes.

In the heating apparatus for cooking as another preferred embodiment of the present invention, the heating process control means prohibits to perform a natural (or normal) thawing process or outputs a warning when the internal temperature of the heating chamber is not less than a predetermined temperature value.

In the heating apparatus for cooking as another preferred embodiment of the present invention, the heating process control means provides a low heating power that is lower than a normal power of the natural thawing process when the internal temperature of the heating chamber is not less than a predetermined temperature value.

In the heating apparatus for cooking as another preferred embodiment of the present invention, the heating process control means controls so that the heating means forcedly heats the target food until a maximum value or a minimum value in the parts in the target food or a value obtained by multiplying the maximum value or the minimum value with a desired ratio is reached to a predetermined value at which the part of the target state is fallen into a boiled state, and then decrease the heating power.

In the heating apparatus for cooking as another preferred embodiment of the present invention, the heating process control means sets a temperature value or a desired temperature range, that is lower than a temperature value at which a boiled state of the target food occurs, during at least one cooking-time period in a thawing process, and controls so that the heating means heats the target food at a constant temperature so that a maximum value or a minimum value in the parts in the target food or a value obtained by multiplying the maximum value or the minimum value with a desired ratio is reached to a predetermined temperature value or within a predetermined temperature range.

In the heating apparatus for cooking as another preferred embodiment of the present invention, the heating process control means sets a plurality of temperature values or a plurality of temperature ranges, that are lower than a temperature value at which a boiled state of the target food occurs, during at least one cooking-time period in a thawing process, and controls so that the heating means heats the target food at a constant temperature during a desired time period so that a maximum value or a minimum value in the parts in the target food or a value obtained by multiplying the maximum value or the minimum value with a desired ratio is reached to a predetermined temperature value or within a predetermined temperature range.

In the heating apparatus for cooking as another preferred embodiment of the present invention, the heating process control means controls the power of the heating means so that a difference between the maximum temperature value and the minimum temperature value in the parts of the target food to be detected is within a desired value.

In the heating apparatus for cooking as another preferred embodiment of the present invention, the heating process control means halts the heating operation by the heating means until the temperature difference is not more than a desired value when a difference between the maximum temperature value and the minimum temperature value in the temperatures of the parts in the target food to be detected is not less than a desired value.

The heating apparatus for cooking as another preferred embodiment of the present invention further comprises initial temperature detection means for detecting an initial temperature of the target food. In the heating apparatus, the heating process control means performs a thawing process based on a different heating control manner corresponding to the initial temperature of the target food detected by the initial temperature detection means.

In the heating apparatus for cooking as another preferred embodiment of the present invention, the heating process control means stops the heating process or outputs a warning without performing any thawing process in order to finish the cooking process when the initial temperature of the target food detected by the initial temperature detection means is not less than a predetermined value.

In the heating apparatus for cooking as another preferred embodiment of the present invention, the heating process control means stops the heating process by the heating means when a maximum value in a calculated temperature value in the direct detection area, where only the target food is detected, and a calculated temperature value of a part in the target food in the boundary detection area, where both the part of the target food and the background are detected simultaneously, is reached to a set temperature value.

In the heating apparatus for cooking as another preferred embodiment of the present invention, the heating process control means stops the heating process by the heating means when a minimum value in a calculated temperature value in the direct detection area, where only the target food is detected, and a calculated temperature value of a part in the target food in the boundary detection area, where both the part of the target food and the background are detected simultaneously, is reached to a set temperature value.

BRIEF DESCRIPTION OF THE DRAWINGS

These and other objects, features, aspects and advantages of the present invention will become more apparent from the following detailed description of the present invention when taken in conjunction with the accompanying drawings, in which.

DESCRIPTION OF THE PREFERRED EMBODIMENTS

Other features of this invention will become apparent through the following description of preferred embodiments which are given for illustration of the invention and are not intended to be limiting thereof.

First Embodiment

Figure 1:
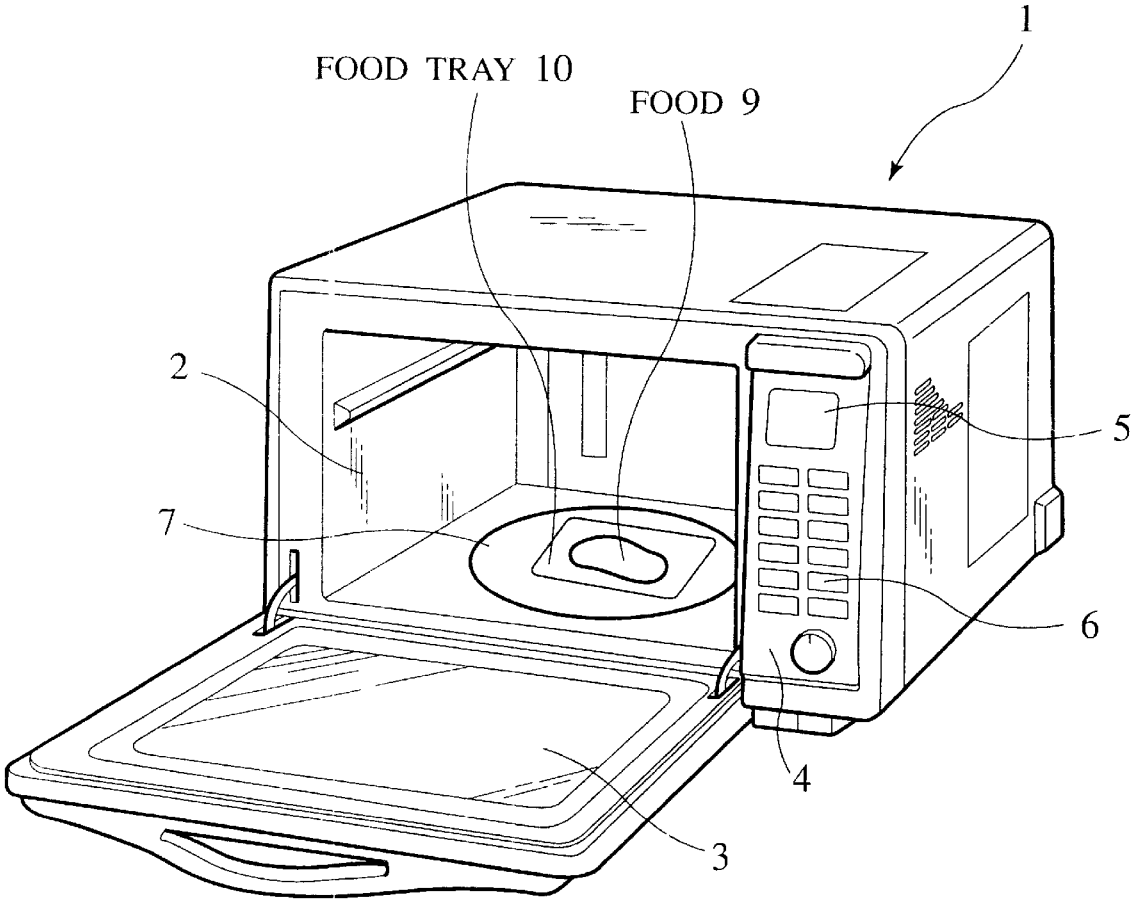
FIG. 1 is a perspective view showing the external appearance of a heating apparatus for cooking according to preferred embodiments of the present invention.
Figure 2:
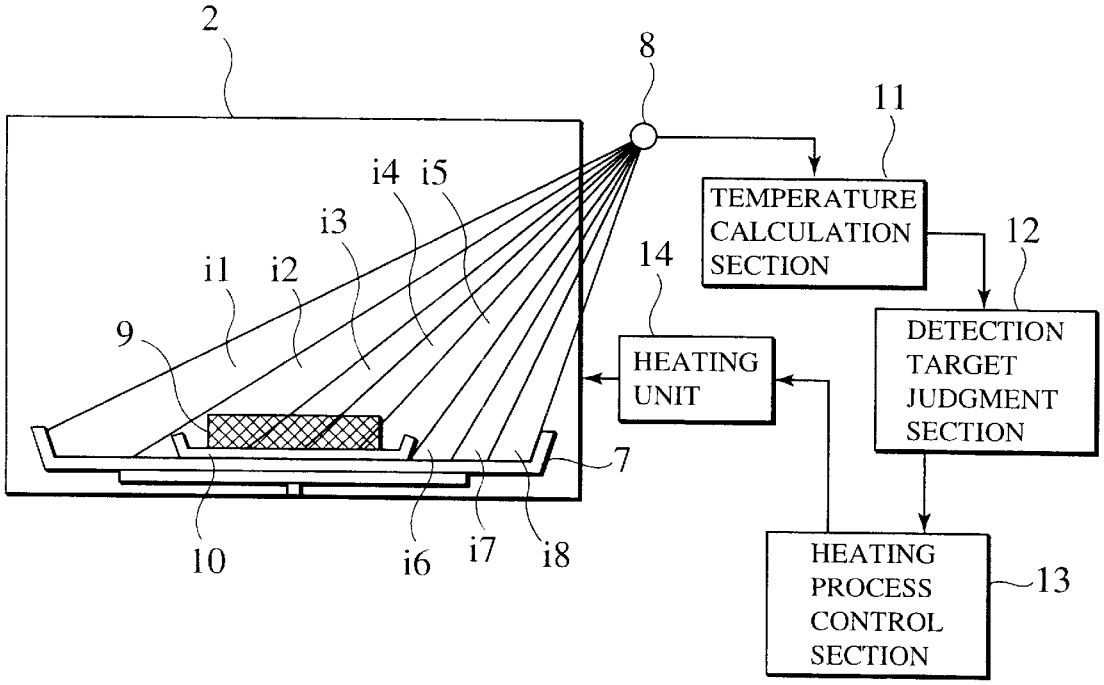
FIG. 2 is a block diagram showing a functional configuration of the heating apparatus for cooking according to the preferred embodiments of the present invention.
Figure 3A:
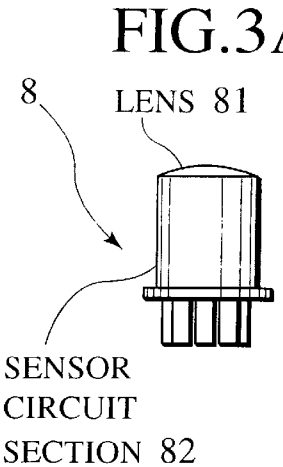
FIG. 3A is a front view of an IR sensor incorporated in the heating apparatus for cooking according to the preferred embodiments of the present invention.
Figure 3B:
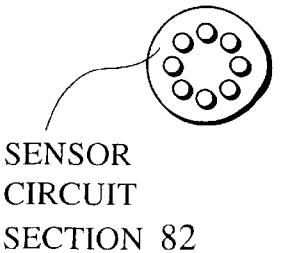
FIG. 3B is a bottom view of the IR sensor incorporated in the heating apparatus for cooking according to the preferred embodiments of the present invention.

FIG. 1 is a perspective view showing the external appearance of a heating apparatus for cooking such as microwave ovens according to preferred embodiments of the present invention. In FIG. 1, the reference number 1 designates the heating apparatus for cooking such as microwave ovens. FIG. 2 is a block diagram showing a functional configuration of the heating apparatus 1 for cooking shown in FIG. 1, and FIGS. 3A and 3B are the front and bottom views of an IR sensor incorporated in the heating apparatus 1 for cooking of the present invention shown in FIG. 1.

In the heating apparatus 1 for cooking of the present invention, the reference number 2 designates a cavity in which a target food 9 (see FIG. 5) to be cooked is placed on a turntable 7. The reference number 3 indicates the door of the cavity 2, 4 designates a control panel with a numerical display window 5 and operation buttons 6 through which the user selects and sets a cooking process, a cooking temperature, and a cooking time period, and the like. The reference number 7 indicates the turntable on which the target food 9 is placed and rotates during cooking according to the cooking process set by the user.

The reference number 8 designates an infrared ray sensor (IR sensor) comprising a plurality of IR elements. The configuration of the IR sensor will be described later. The IR sensor 8 is placed at a position where a temperature of the target food 9 and its peripheral area can be detected. The target food 9 is placed on a food tray 10 in the cavity 2.

As shown in FIG. 2 in detail, a heating control section comprises the IR sensor 8, a temperature calculation section 11, a detection target decision section 12, a heating process control section 13, and a magnetron (in a case for an electric range) or a magnetron and a heater (in a case for an electric and oven range). All of or each of the above functions in the heating control section 11 are incorporated into one or more programs and these programs are also incorporated in microcomputer chips (semiconductor chips) of one or more. A memory to store various data items to be used for the above functions is also incorporated in the microcomputer chip.

Figure 4:
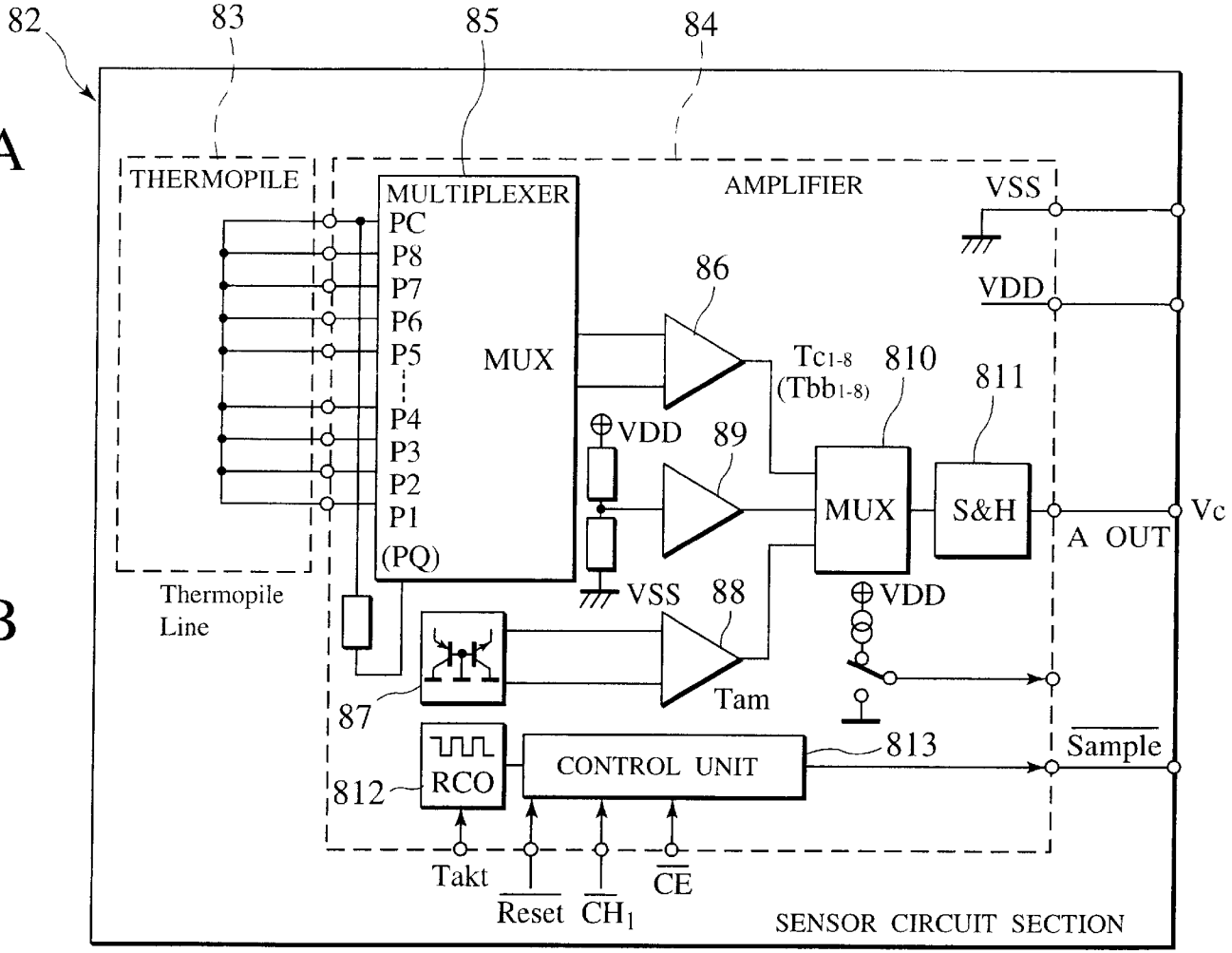
FIG. 4 is a circuit diagram of the IR sensor incorporated in the heating apparatus for cooking according to the preferred embodiments of the present invention.

FIGS. 3A and 3B show the configuration of the IR sensor 8. FIG. 4 is a diagram showing a circuit configuration of the IR sensor 8 shown in FIGS. 3A and 3B.

The IR sensor 8 shown in both FIGS. 3A and 3B comprises a lens 81 and a sensor circuit section 82. The sensor circuit section 82 is made up of electrical components. The lens 81 is a concave lens made up of silicon through which only infrared ray is transmitted.

As shown in FIG. 4, the sensor circuit section 82 comprises a thermopile 83 in which eight linear elements as sensor are arranged in linear and, an amplifier circuit 84 for amplifying the output from the thermopile 83.

The amplifier circuit 84 comprises: a multiplexer 85 for selecting the output from each linear element in the thermopile 83 and for outputting the selected one serially; an amplifier 86 for amplifying the output from the multiplexer 85; a self temperature sensor 87 for detecting a standard temperature; an amplifier 88 for amplifying the output from the self temperature sensor 87; a standard voltage unit 89; a multiplexer 810; output circuit 811; an oscillator 812; and a control unit 813.

The output voltage V from the eight linear elements in the thermopile 83 in the sensor circuit 82 is as follows:

$$V=\nu(T_{bb}^4-T_{am}^4),$$

where V is an output voltage, ν is an adaptation coefficient, Tbb is an absolute temperature of the target food, and Tam is an absolute temperature of the IR sensor.

The adaptation coefficient ν can be expressed as follows based on the temperature Tc of a black body and the output voltage Vc in temperature calibration:

$$\nu = \frac{V_c}{T_c^4 - T_{am}^4}.$$

Finally, the temperature Tbb of the target food can be expressed as follows:

$$T_{bb} = \sqrt[4]{\frac{V}{\nu} + T_{am}^4}.$$

Figure 5:
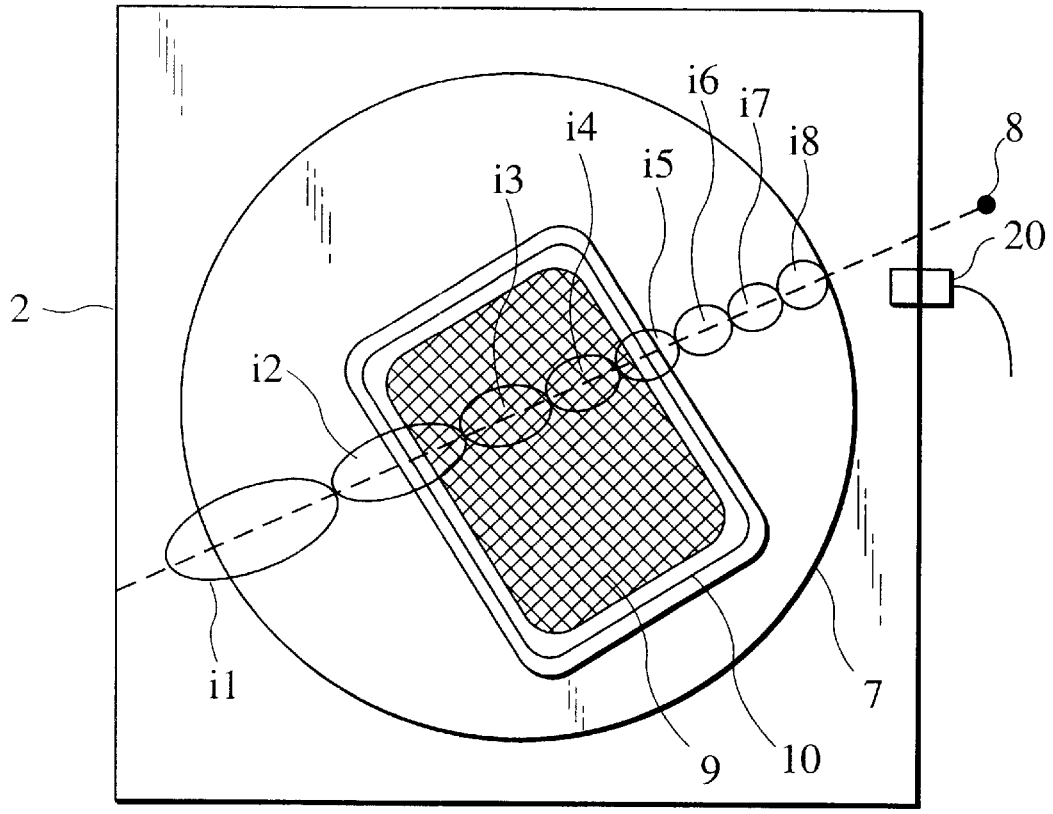
FIG. 5 is a diagram showing detection fields of the IR sensor in the heating apparatus for cooking according to the preferred embodiments of the present invention.
Figure 6:
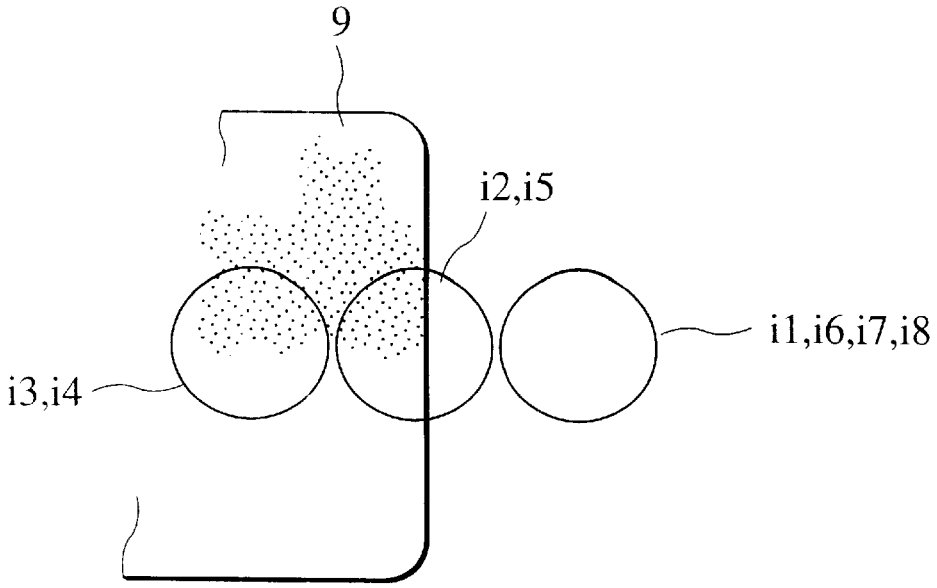
FIG. 6 is a diagram showing a direct detection field, boundary detection fields, and background detection fields of the IR sensor in the heating apparatus for cooking according to the preferred embodiments of the present invention.

FIG. 5 is a diagram showing the detection fields i1 to i8 of the IR sensor 8 in the heating apparatus 1 for cooking according to the present invention. FIG. 6 is a detailed diagram showing the direct detection fields i3 and i4, the boundary detection fields i2 and is, and the background detection fields i1, i6, i7, and i8 of the IR sensor 8 in the heating apparatus 1 for cooking according to the present invention.

As shown in FIG. 5 in detail, the linear elements in the thermopile 83 in the IR sensor 8 are arranged in order to have the detection fields i1 to i8 (The reference characters i1 to i8 will be also used for designating the linear elements having the detection fields i1 to i8 briefly.) so that the entire linear elements cross the turntable 7 in the cavity 2 in diameter direction. The IR sensor 8 comprising the eight linear elements can detect the temperature of the entire area of the turntable 7 per rotation. For example, the detection fields of the linear elements i1 to i8 (The reference characters i1 to i8 will be also used for designating the detection fields i1 to i8 briefly.) in the IR sensor 8 per 360°/m (m is a positive integer and m means a rotation number of the turntable 7.) are expressed by i1θ1 to i8θ1, . . . , and i1θm to i8θm because the entire surface of the turntable 7 can be detected every rotation angle of 360°/m, namely, m=1 means the first rotation, m=2 means the second rotation, . . . , m indicates the m-th rotation.

The temperature calculation section 11 calculate a temperature value of each detection field based on each temperature detection signal transferred from each of the linear elements in the IR sensor 8 and then outputs the calculated temperature values to a memory (not shown). The contents stored in the memory are thereby updated.

The detection target judgment section 12 judges the type of each of the detection fields i1 to i8, such as a direct detection field where any target food is placed, a boundary detection field in which there are both the target food and the background, or the background detection field where there is no target food, based on the calculated temperature value of each detection field and then outputs the information of the type of each detection field and the calculated temperature values to the heating process control section 13.

The heating process control section 13 sets cooking processes such as a cooking temperature for the target food, a heating time period, and the like based on the instructions such as "thawing food", or "thawing and warming food", "warming food", transferred form the operation panel 4, in order to control the cooking processes based on the calculated temperature values of the detection fields output from the detection target judgment section 12.

Next, a description will be given of the operation of the heating apparatus 1 for cooking having the above-described configuration.

The temperature calculation section 11 calculates the calculated temperature values based on the temperature detection signal output from each of the linear elements in the IR sensor 8 and then outputs the calculated temperature values to the detection target judgment section 12.

The operation of the detection target judgment section 12 is as follows.

There are following three types (1), (2), and (3) in the detection fields according to the detection fields i1θ1 to i8θ1, . . . , and i1θm to i8θm (m is a positive integer indicating a rotation number) per rotation detected by the linear elements in the IR sensor 8.

(1) Background Detection Field

There is no target food in the background detection field, for example, the detection fields i1, i6, i7, and i8 shown in FIG. 5. The linear element corresponding to each of the detection fields i1, i6, i7, and i8 detects the temperature of the background detection field.

(2) Direct Detection Field

There is only the target food 9 in the direct detection field, for example, the detection fields i3 and i4 shown in FIG. 5. The linear element corresponding to each of the detection fields i3 and i4 detects the temperature of the target food 9.

(3) Boundary Detection Field

There are both the target food 9 and the background detection field, for example, the detection fields i2 and i5 in the boundary detection field.

The temperature of the target food 9 is necessary to control the heating. Although any conventional microwave oven detects the difference of the direct detection field and the background detection field to obtain the temperature of the target food to be cooked, any conventional microwave oven detects no boundary detection field, so that it is difficult to detect the temperature of the target food preciously. That is, the conventional microwave ovens control the heating process based on a mean value of the temperatures of both the background detection field and the target food because the conventional microwave ovens cannot detect the temperature at the boundary detection field preciously. In particularly, it often happens in the conventional microwave ovens that a part of the target food placed in the boundary detection field becomes a half-cooked state locally or enters a half-boiled state during thawing process. Thus, the conventional microwave ovens cannot detect preciously a part of the target food placed in the boundary detection field where it often happens a half-cooked state.

The detection target judgment section 12 in the heating apparatus 1 for cooking of the present invention judges the type of the detection field, and then obtains the temperature of the part of the target food and outputs the calculated value to the heating process control section 13.

The heating process control section 13 controls the operation of the heating unit 14 based on the calculated temperature value of each part of the target food 9 from the detection target judgment section 12 until the temperature of the target food 9 is reached to the set temperature according to the cooking process.

The detection target judgment section 12 in the heating apparatus 1 for cooking of the first embodiment specifies a part of the target food that is placed in the boundary detection field and then calculates a ratio of the area of the target food and the area of the background in the boundary detection field based on the following process:

First, the background temperature Tbk of the background is determined by using the temperature (as the background temperature) of the self-temperature sensor 87 incorporated in the IR sensor 8.

Because it can be assumed that each part in the heating apparatus 1 for cooking has a same temperature value during a stable state, it is possible to use the temperature, as the temperature of the background, detected by the self-temperature sensor 87 to be incorporated for temperature calibration in the IR sensor 8.

During the thawing and heating process, the heating process control section 13 inputs data corresponding to the initial temperature distribution in the cavity 2 transferred from the temperature calculation section 11 and then estimates the initial temperature Tfini of the target food 9 based on the minimum value of the detected temperatures in the initial temperature distribution. Because the target food 9 is usually in a frozen state and the temperature of the target food 9 is apparently lower than the temperature of the cavity (as the temperature of the background) in the heating apparatus 1 for cooking at the initial state of the thawing and heating process, the initial temperature of the target food 9 can be obtained simply and preciously.

The heating process control section 13 inputs the entire temperature Tjwhl of the detection fields ij (each i and j is a positive integer, and j is also the number of the detection field which is considered to be the boundary detection field, and the boundary detection field ij will be designated by using an angle θk of rotation angle (k=1, . . . , m), for simple explanation.) calculated by the temperature calculation section 11. Then, the heating process control section 13 calculates the ratio Sjf of the target food 9 in the boundary detection field ij as follows:

$$Sjf = \frac{Tjwhl - Tbk}{Tjini - Tbk}.$$

Thereby, the ratio S5f of the target food 9 in the boundary detection field i5 can be obtained as follows when the calculated temperature value T5 in the boundary detection field i5 is 15° C., the temperature of the background is 25° C., and the initial temperature Tfini of the target food 9 is −5° C., for example:

$$Sjf = \frac{Tjwhl - Tbk}{Tjini - Tbk} = \frac{15 - 25}{-5 - 25} = \frac{-10}{-30} = \frac{1}{3}.$$

Thereby, it can be estimated that the ratio of the target food in the boundary detection field S5f is ⅓.

Then, the temperature Tjf of the part in the target food 9 in the boundary detection field can be obtained by the following equation during the heating control process, where the calculated temperature value is directly used as the temperature Tkbk of each background field ik, and the calculated values is also directly used as the temperature Tmf of the target food 9 in the direction detection field im.

$$Tjf = \frac{Tjwhl - Tbk + Sjf \cdot Tbk}{Sjf},$$

where, Tjwhl is the calculated value for the entire temperature of the boundary detection fields ij, Tbk is the temperature of the background field that is obtained by using a mean value of the background fields ik at the detection.

For example, when the temperature of the background field is 25° C., the calculated temperature value Tjwhl of the boundary detection field is 20° C., and the ratio Sjf of the target food in the boundary detection field is ⅓, the temperature Tjf of the target food 9 in the boundary detection field ij can be obtained as follows:

$$Tjf = \frac{Tjwhl - Tbk + Sjf \cdot Tbk}{Sjf} = \frac{20 - 25 + \frac{1}{3} \cdot 25}{\frac{1}{3}} = 10.$$

Thereby, it can be recognized that the target food in the boundary detection field ij has been heated from −5° C. to 10° C. The heating process control section 13 calculates the temperature value of the part of the target food 9 in the direction detection field and the temperature value of the part of the target food 9 in the boundary detection field by using the temperature detection signals transferred from the IR sensor 8 and controls the heating process of the heating unit 14 and controls the heating process for the cooking of the target food 9.

Next, a description will be given of the heating control in the heating apparatus for cooking according to the first embodiment of the present invention with reference to the flow chart shown in FIGS. 7 and 8.

Figure 7:
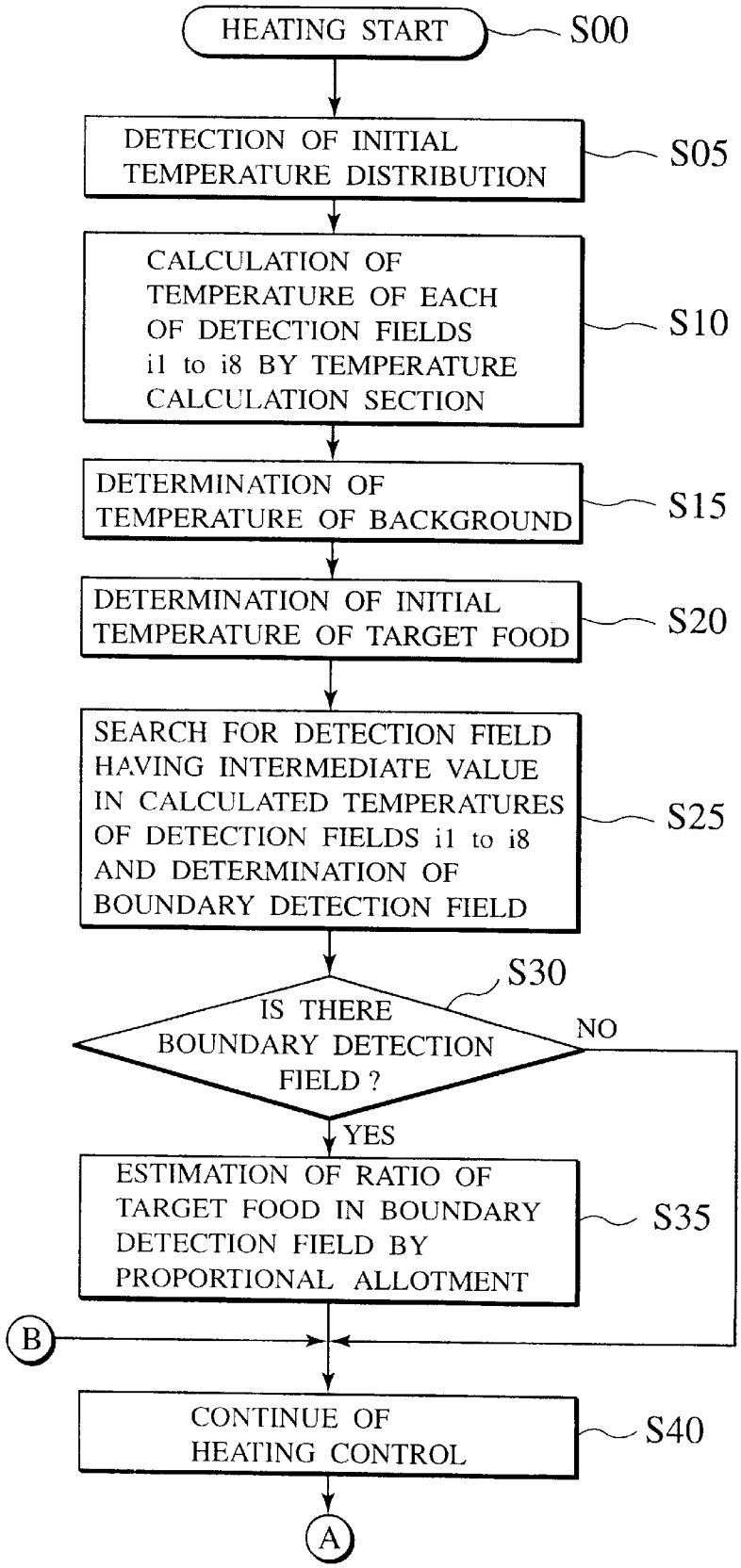
FIG. 7 is a first half of a flowchart showing a control of a thawing and heating process in the heating apparatus for cooking of the first embodiment.
Figure 8:
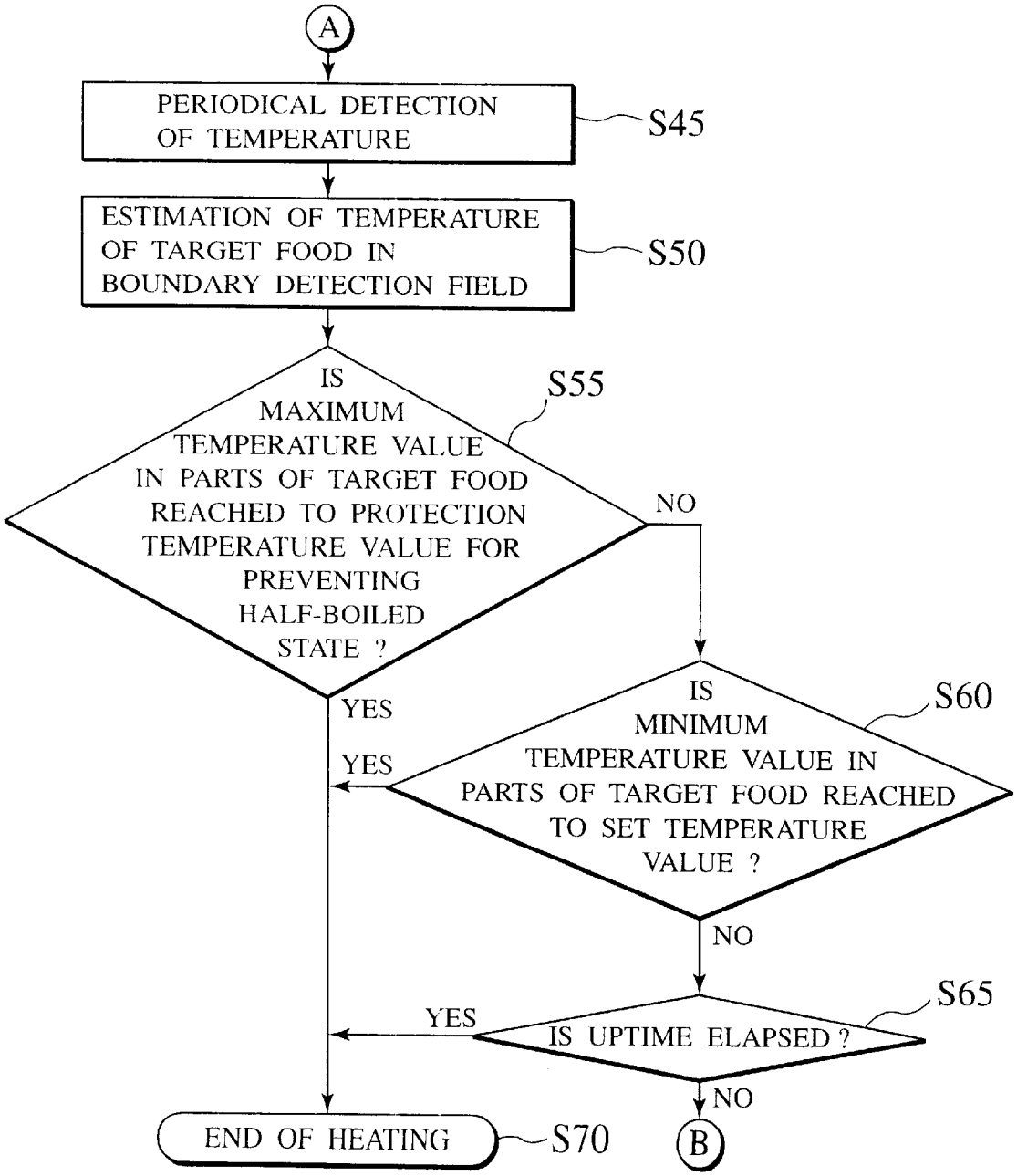
FIG. 8 is a latter half of the flowchart showing the control of the thawing and heating process in the heating apparatus for cooking of the first embodiment.

FIG. 7 is the first half of the flowchart showing the control of the thawing and heating process in the heating apparatus for cooking of the first embodiment and FIG. 8 is the latter half of the flowchart showing the control of the thawing and heating process in the heating apparatus for cooking of the first embodiment.

When the start button for initiating the heating process is pushed, the induction heating by a magnetron as one of the heating processes is initiated (Step S00) during a predetermined time period that is set in advance in a timer, and the IR sensor 8 detects the initial temperature distribution and outputs it to the temperature calculation section 11. These operations are performed in parallel. In addition, a self-temperature detection signal is also transferred to the temperature calculation section 11 (Step S05).

The temperature calculation section 11 performs the temperature calculation for the temperature detection signal transferred from each:Linear element corresponding to detection fields i1 to i8 in the IR sensor 8 in order to obtain the calculated temperature values for each of the detection fields i1θ1 to i8θ1, . . . , and i1θm to i8θm. In addition, the temperature calculation section 11 also obtains the self-temperature based on the self-temperature detection signal from the IR sensor 8 (Step S10).

The detection target judgment section 12 judges the direct detection field, the background detection field, and the boundary detection field (Steps S15 to S25) based on the calculated temperature values transferred form the temperature calculation section 11. That is to say, the detection target judgment section 12 determines the internal temperature (as the initial background temperature) of the cavity 2 by using the calculated temperature values based on the self-temperature detection signal from the IR sensor 8 (Step S15) and also obtains the initial temperature value of the target fold 9 based on the minimum temperature value in the calculated temperature value (Step S20).

The detection target judgment section 12 then judges that the detection field whose temperature is approximately equal to the initial temperature value of the target food 9 is the direction detection field, the detection field whose temperature is approximately equal to an intermediate temperature value between the initial temperature value of the background and the initial temperature value of the target food 9 is the boundary detection field. Then, the detection target judgment section 12 connects each of the calculated temperature values corresponding the detection fields i1θ1 to i8θ1, . . . , and i1θm to i8θm to each type of the detection fields such as the direct detection field, the boundary detection field, and the background detection field. Then, the detection target judgment section 12 transfers the judgment results to the heating process control section 13 (Step S25).

The heating process control section 13 estimates the ratio of the target food 9 in the boundary detection field based on the results transferred from the detection target judgment section 12 by a proportional allotment (Step S30 and Step S35). After this process, the heating process control section 13 continues to perform the control of the heating based on the indicated heating process (Step S40). During the heating in the thawing and heating process, the IR sensor 8 periodically detects the temperature of the internal cavity 2 (Step S45), and the heating process control section 13 observes the temperature of the target food 9 in both the direct detection field and the boundary detection field and estimates the temperature of the target food 9. The heating process control section 13 continues to perform these operations (Step S50). When one of the temperatures in the direct detection field and the boundary detection field is reached to a protection temperature value that is set in advance, for example 28° C., based on the temperature 30° C. at which a part of the food is fallen into the half-boiled state of a food locally, the heating is halted (Step S55 and S75).

At Step S55, even if the calculated temperature of any part in the target food 9 is not reached to the protection temperature, the heating is stopped when all of the calculated temperatures are reached to a predetermined temperature value that is set in advances (Steps S60 and S70). Further, even if the calculated temperature of any part in the target food is not reached to the predetermined temperature value, the heating is also stopped when the heating time is over the set value in the timer (Steps S55 and S75).

By using the manners described above, the heating apparatus for cooking of the first embodiment can perform the thawing and heating process for a frozen food item to be cooked so that the half-boiled state does not occur in any part of the target frozen food item while the IR sensor detects the temperature of each part of the target frozen food item. In the heating apparatus for cooking of the first embodiment, the IR sensor 8 obtains the initial value of the internal temperature of the cavity 2 by using the temperature value detected and transferred from the self-temperature sensor 87 to be used for detecting a standard temperature incorporated in the IR sensor 8. However, the present invention is not limited by this, for example, it is also possible to use a temperature signal detected by a temperature sensor, instead of the self-temperature sensor 87, incorporated in the heating apparatus for cooking such as a thermister that directly detects the internal temperature of the cavity 2 during oven process.

Figure 9:
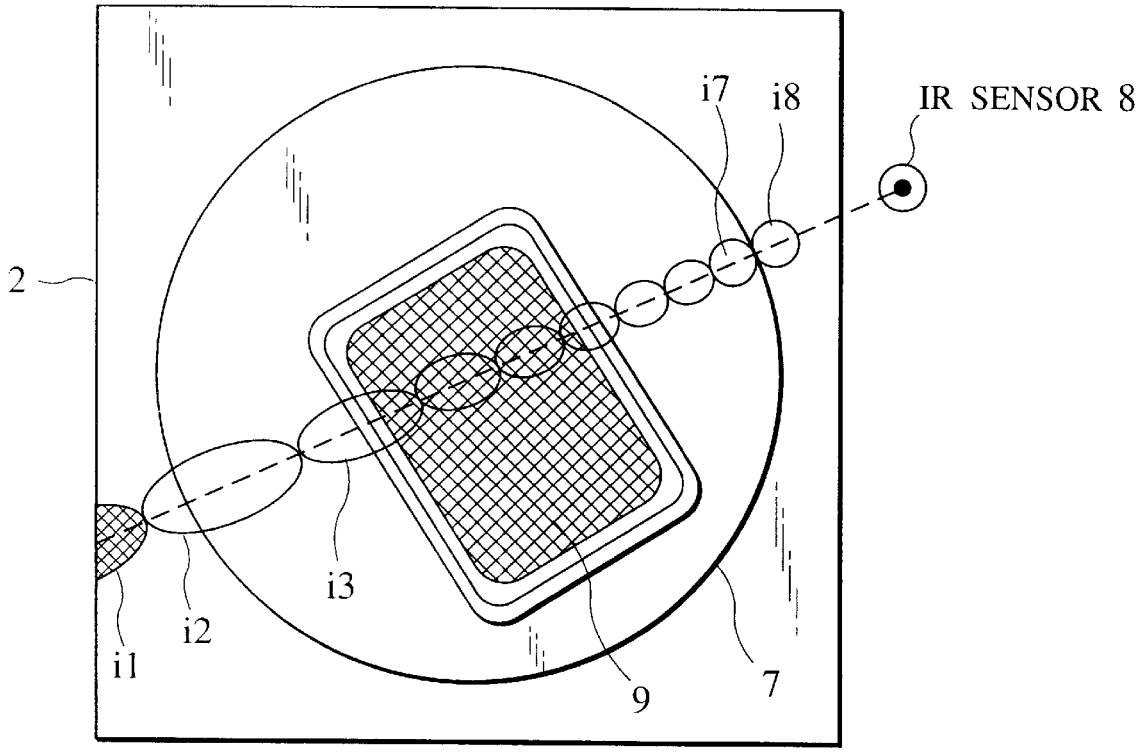
FIG. 9 is a diagram showing another detection field of the IR sensor in the heating apparatus for cooking of the first embodiment.

FIG. 9 is a diagram showing another detection fields of the IR sensor 8 in this heating apparatus 1 for cooking of the first embodiment. As shown in FIG. 9, one of the linear elements having the detection fields i1 to i8 (These reference characters i1 to i8 will be also used for the detection fields i1 to i8 briefly.) in the IR sensor 8 is placed on a position where a temperature of a target food 9 of any size placed on the turntable 7 cannot be detected, end the temperature value of the background field can be obtained based on the calculated temperature values from the detection fields i1θ1 to i8θ1, . . . , or i1θm to i8θm.

Furthermore, the following detection manner may be used in order to obtain the temperature of the background field.

In FIG. 5, when the turntable 7 is rotated during the heating process, the target food 9 placed on the turntable 7 is also turned. On the other hand, the absolute position of the detection field of each of the linear elements i1 to i8 in the IR sensor 8 is fixed in the cavity 2. Therefore while the turntable 7 and the target food 9 are turned per rotation, the linear element i1 detecting the most outer periphery of the turntable 7 or the linear element i8 detecting the most inner periphery has two detection fields, one detection field detects only the target food 9 and another detection field detects only the background field, because it does not occur in general cases that the size of the target food 9 is equal to or over the size of the turn table 7. Accordingly, the maximum value in the temperature values detected by the linear element i1 or i8 during one rotation is used as the initial temperature value of the background field.

In particularly, because it does not occur in ordinary circumstances that the internal temperature of the cavity 2 is fallen under the freezing point (0° C.) and a frozen food is normally used in the thawing and heating process, it is possible to obtain the precious temperature of the background field based on the maximum temperature value described above.

Second Embodiment

The configuration of the heating apparatus for cooking according to the second embodiment is the same as that of the heating apparatus for cooking of the first embodiment shown in FIGS. 1 and 2. The difference between them is the detection function of the background field in the initial heating state.

A description will be given of the heating control operation of the heating apparatus 1 for cooking of the second embodiment with reference to the flowchart shown in FIGS. 10 and 11.

Figure 10:
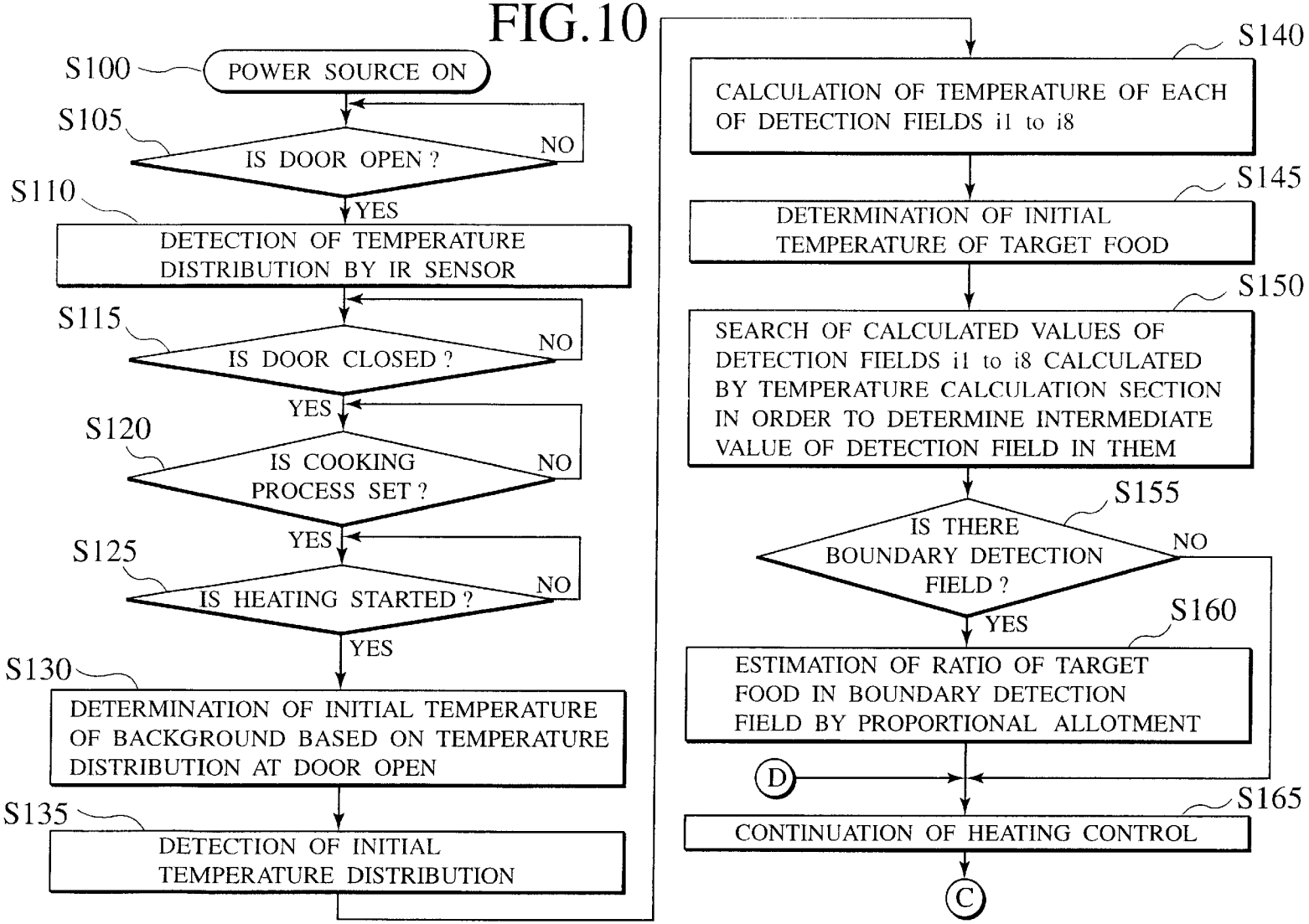
FIG. 10 is a first half of a flowchart showing a control of a thawing and heating process in the heating apparatus for cooking of the second embodiment.
Figure 11:
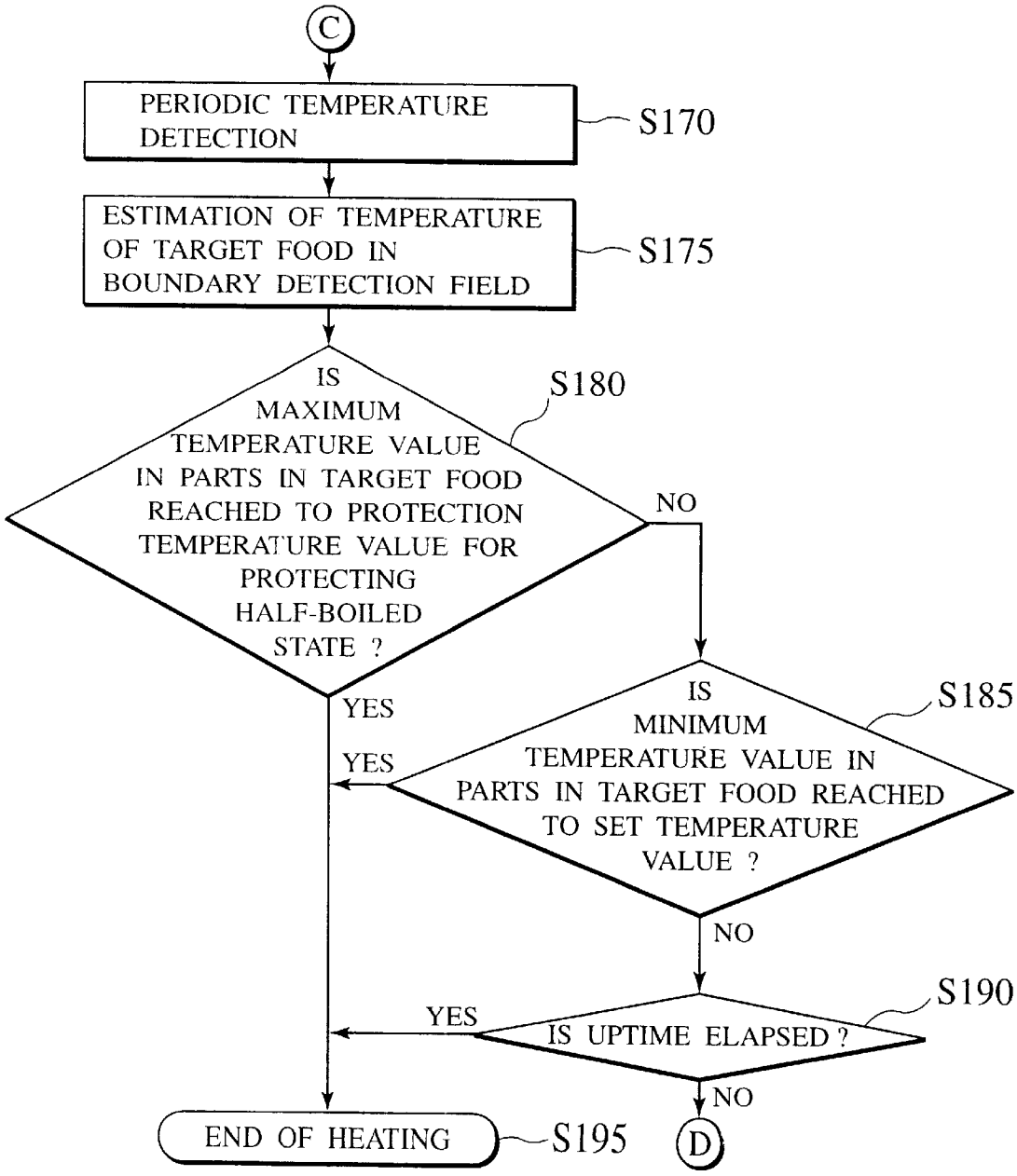
FIG. 11 is a latter half of the flowchart showing the control of the thawing and heating process in the heating apparatus for cooking of the second embodiment.

FIG. 10 is the first half of the flowchart showing the control of the thawing and heating process in the heating apparatus for cooking of the second embodiment and FIG. 11 is the latter half of the flowchart showing the control of the thawing and heating process in the heating apparatus for cooking of the second embodiment.

Hereinafter, the case in which the power supply of the heating apparatus 1 for cooking is ON, the thawing is selected as the cooking process, and the heating start button is pushed by the suer will be explained.

When the power supply of the heating apparatus 1 for cooking is ON (Step S100), the procedure shown in FIGS. 10 and 11 is started. When the user open the door 3 of the heating apparatus 1 for cooking the target fool 9, the IR sensor 8 initiates the temperature detection operation and outputs the detection signals to the temperature calculation section 11. The temperature calculation section 11 inputs the temperature detection signals and then calculates the detected temperature values based on the temperature detection signals and stores the calculated results into the memory (Steps S105 and S110).

When the user places the target food 9 to be cooked on the turntable 7 in the cavity 2, and closes the door 3 of the heating apparatus 1 for cooking. Then, the user pushes the button on the operation panel 4 to select the thawing and heating process, and then pushes the start button. The heating process control section 13 in the heating apparatus 1 for cooking sets the cooking process based on the user's selection, and initiates the control of the thawing and heating process during the time period that is set in advance in a timer according to an induction heating by a magnetron in the heating unit 14 shown in FIG. 2 (Step S115 to Step S125).

The thawing and heating process will be explained in detail. When the thawing (namely, the heating) is initiated, the temperature calculation section 11 calculates the mean value of the detected temperature values of the detection fields i1θ1 to i8θ1, . . . , and i1θm to i8θm in order to obtain the initial background temperature (Step S130) based on the initial temperature distribution obtained when the user opens the door 3 for placing the target food 9 on the tray 10 on the turntable 7.

After this, the temperature calculation section 11 calculates the temperature calculation values for each of the detection fields i1θ1 to i8θ1, . . . , and i1θm to i8θm (Steps S135 and S140) based on following detected temperature signals detected by the IR sensor 8.

The heating process control section 13 determines the initial temperature value for the target food 9 according to the minimum temperature value in the temperature calculated values for each detection field (Step S145). The detection target judgment section 12 judges the type of each detection field such as the direct detection field, the background field, and the boundary detection field based on the temperature calculated values, like the first embodiment (Step S150). That is, the detection target judgment section 12 determines that the detection field having the temperature near the initial temperature is the direct detection field, the detection field having an intermediate temperature value between the initial temperature of the target food 9 and the initial background temperature is the boundary detection field. Then, the detection target judgment section 11 performs to connect the temperature calculated value for each of the detection fields i1 to i8 to one of the types, the direct detection field, the background field, and the boundary detection field. Then the detection target judgment section 12 outputs the judgment results to the heating process control section 13 (Step S155).

The heating process control section 13 estimates the ratio of the target food 9 in the detection field based on the judgment results from the detection target judgment section 12 by using the prescribed manner (Step ST160) when the type of the detection field is the boundary detection field. The heating process control section 13 continues to control the heating by the specified manner (Step S165).

The IR sensor 8 continues to periodically detect the internal temperature of the cavity 2 during the thawing and heating process (Step S170), and the heating process control section 13 checks the temperature of the target food 9 in both the direct detection field and the boundary detection field, and the temperature of the target food 9 in the boundary detection field is estimated by the manner described above (Step S175).

Finally, the heating is stopped when the estimated temperature of the target food 9 is reached to the protection temperature (for example, 28° C.) at which the food becomes a half-boiled state (Steps S180 and S195).

At Step S180, even if the temperatures of any part in the target food 9 obtained in the direct detection field and the boundary detection field are not reached to the protection temperature, the heating is stopped when all of the calculated temperatures are reached to the predetermined temperature value that is set in advance (Steps S185 and S195). Further, even if the calculated temperatures of any part in the target food are not reached to the predetermined temperature value, the heating is also stopped when the heating time is over the set value of the timer (Steps S190 and S195).

Like the first embodiment, the heating apparatus for cooking of the second embodiment can perform the thawing and heating process for a frozen food to be cooked so that the half-boiled state does not occur in any part of the target frozen food while the IR sensor detects the temperature of each part of the target frozen food. Furthermore, The IR sensor 8 also detects the internal temperature distribution of the cavity 2 where no target food is placed in order to get the temperature of the background where the power supply of the heating apparatus for cooking is ON, and the mean value of the initial temperature values is determined as the initial temperature of the background based on the initial temperature distribution of the cavity 2. Thus, the second embodiment of the present invention can obtain the initial temperature of the background preciously by using the temperature distribution when the user places the target food 9 on the turntable 7 in the cavity 2 in the heating apparatus for cooking.

In addition, it is also possible to use the maximum value, the minimum value, or the mean value between the maximum value and the minimum value, in the initial temperature distribution detected by the IR sensor 8 in order to obtain the initial temperature of the background.

Third Embodiment

The heating apparatus for cooking of the third embodiment of the present invention will be explained.

The configuration of the heating apparatus for cooking according to the third embodiment is the same as that of the heating apparatus fox cooking of the first embodiment shown in FIGS. 1 and 2. The difference between them is the function to determine the ratio of the target food in the boundary detection field.

During the heating process, the heating apparatus for cooking of the third embodiment determines the positions of the boundary detection fields many times by using the temperature distribution based on the detection results which are obtained repeatedly by the IR sensor 8, and also determines the ratio of the target food in the boundary detection fields, and also determines the temperature of the target food in the boundary detection field in order to control the heating for avoiding an occurrence of the half-boiled state in the target food.

For example, when the target food 9 is placed on the turntable 7 in the cavity 2, the tray 10 (see FIG. 10) is rapidly increased toward the temperature of the background in the initial heating state. However, the temperature of the watery target food 9 in a frozen states is not changed, namely cannot be increased rapidly.

In this state, when the ratio of the target food 9 in the boundary detection field is determined by only one temperature detection by the IR sensor 8, it is possible to occur a mistake that a part of the tray 10 whose temperature in the initial heating state is almost equal to that of the target food 9 is a part of the target food 9. This causes to get a wrong ratio of the target food 9 in the boundary detection field.

In order to avoid this case, the heating apparatus for cooking of the third embodiment performs many times the judgment of the detection fields by the IR sensor 8 in the initial heating process and the determination of the ratio of the target food in the boundary detection field, and then the final result is used for the following heating process.

Next, a description will be given of the heating control operation of the heating apparatus for cooking of the third embodiment with reference to the flowchart shown in FIGS. 12 and 13.

Figure 12:
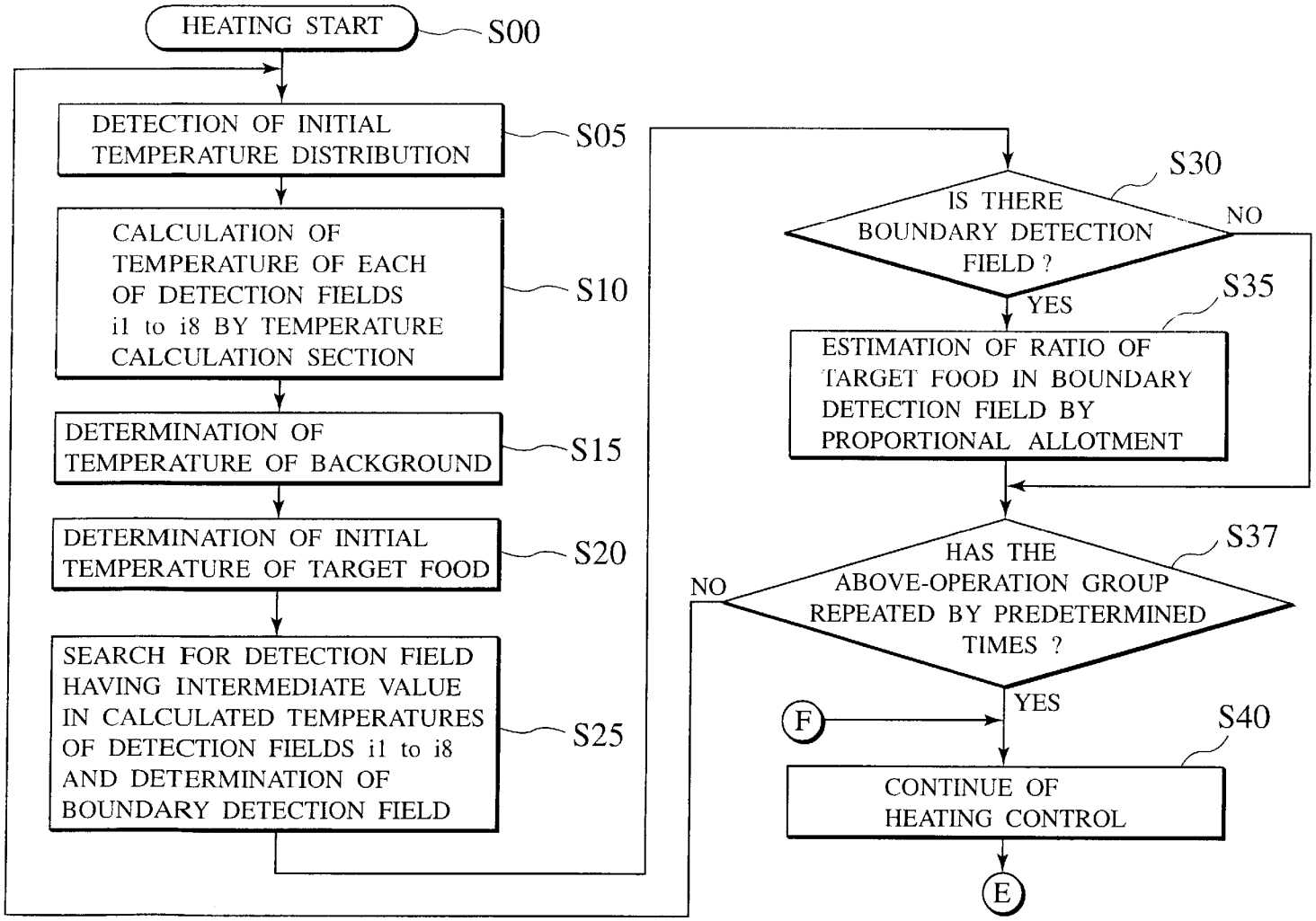
FIG. 12 is a first half of a flowchart showing a control of a thawing and heating process in the heating apparatus for cooking of the third embodiment.
Figure 13:
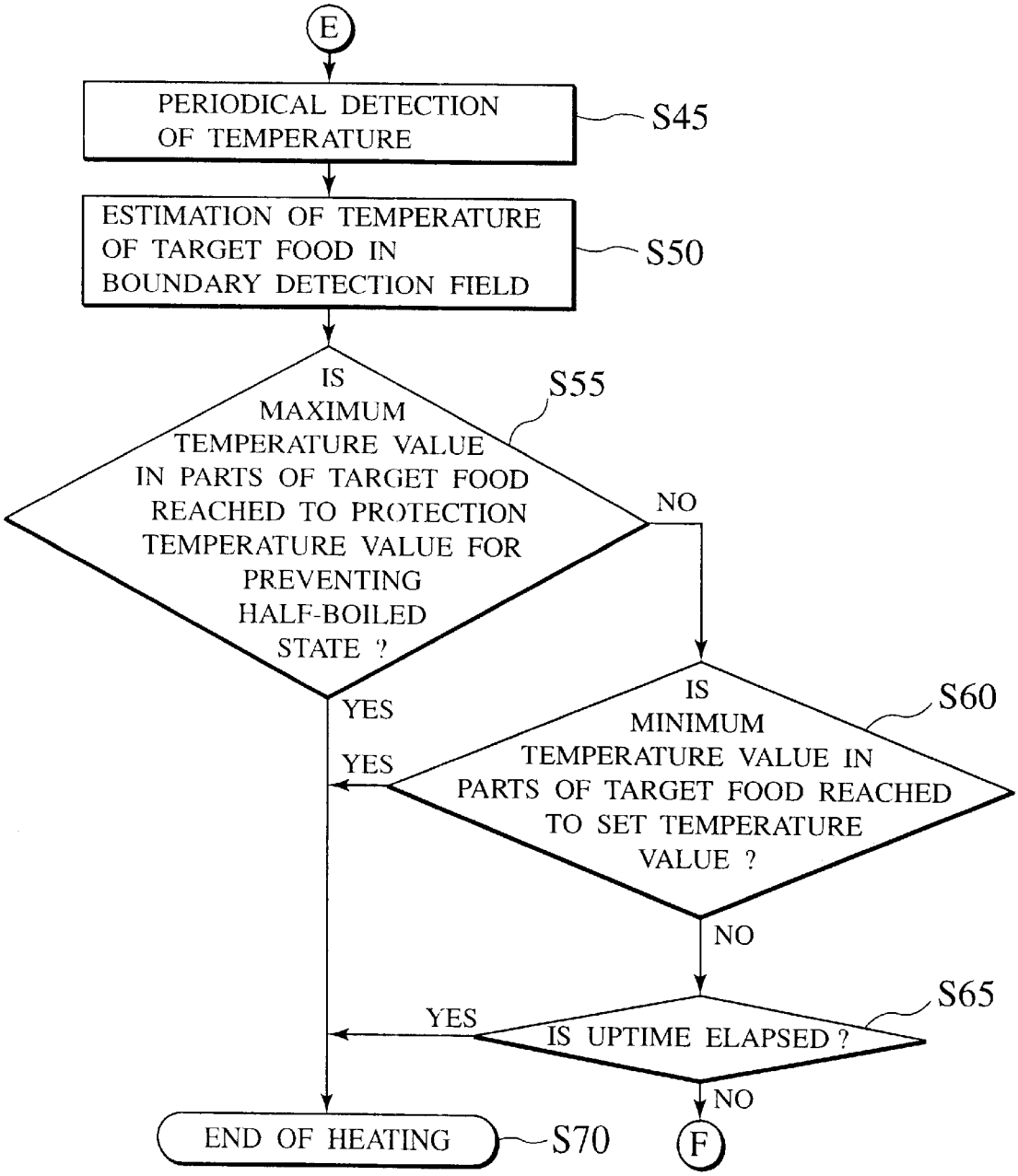
FIG. 13 is a latter half of the flowchart showing the control of the thawing and heating process in the heating apparatus for cooking of the third embodiment.

FIG. 12 is the first half of the flowchart showing the control of the thawing and heating process in the heating apparatus for cooking of the third embodiment and FIG. 13 is the latter half of the flowchart showing the control of the thawing and heating process in the heating apparatus for cooking of the third embodiment.

The operations (such as the detection of the initial temperature distribution, the temperature calculation for each of the detection fields i1θ1 to i8θ1, . . . , and i1θm to i8θm, the judgment of the type of the detection field, the determination of the boundary detection field, and the calculation of the ratio of the target food in the boundary detection field) shown in Steps S05 to S35 after the power supply of the heating apparatus 1 for cooking is ON (Step S00) are the same as those of the first embodiment shown in FIGS. 7 and 8.

Next, the heating apparatus for cooking of the third embodiment repeats predetermined times, for example five times, the operations of the Steps S95 to S35 during the initial heating process even if the ratio of the target food in the background detection field is calculated in order to obtain and a correct type of the detection field and the precious ratio of the target food in the boundary detection field (Step S37).

After this, the heating process control section 13 continues the heating process by the specified heating manner (Step S40). During the thawing and heating process, the heating apparatus for cooking of the third embodiment continues to periodically perform the temperature detection for the internal cavity 2 by the IR sensor 8, like the heating apparatus for cooking of the first embodiment (Step S45), the heating process control section 13 checks the temperature of the target food 9 in the direct detection field and the boundary detection field, and estimates the temperature of the target food 9 in the boundary detection field based on the prescribed manner (Step S50).

When the estimated temperature of the part of the target food 9 in one of the direct detection field and the boundary detection field is reached to the protection temperature at which the part of the target food 9 becomes the half-boiled state, the heating process control section 13 stops the heating process (Steps S55 and S70).

On the other hand, even if the temperatures of any part in the target food 9 obtained in the direct detection field and the boundary detection field are not reached to the protection temperature, the heating is stopped when the calculated temperature is reached to a predetermined temperature value that is lower than the protection temperature and set in advance (Steps S65 and S70). Further, even if the calculated temperature value of any part in the target food are not reached to the predetermined temperature value, the heating is also stopped when the heating time is over the set value of the timer (Steps S65 and S70).

Like the first embodiment, the heating apparatus for cooking of the third embodiment can perform the thawing and heating process for a frozen food to be cooked so that the half-boiled state does not occur in any part of the target frozen food while the IR sensor 8 detects the temperature of each part of the target frozen food.

Furthermore, because the calculation process of the ratio of the target food is repeated many times during the initial heating process in the first embodiment, it is possible to obtain the correct ratio of the target food where the target food 9 is distinguished from the tray 10 when the heating is initiated after the target food 9 is placed on the tray 10 and then placed into the cavity 2.

Moreover, even if the position of the target food 9 is changed when the target food 9 contacts the internal wall of the cavity 2 after the start of the heating, the heating apparatus for cooking of the second embodiment can obtain the correct ratio of the target food 9 in the boundary detection field after the target food 9 is changed and fixed in position and performs the following heating control.

In addition, it is possible for the heating apparatus for cooking of the third embodiment to use the manner of the first embodiment or second embodiment to determine the temperature of the background field.

Fourth Embodiment

The heating apparatus for cooking of the fourth embodiment of the present invention will be explained.

The configuration of the heating apparatus for cooking according to the fourth embodiment is the same as that of the heating apparatus for cooking of the first embodiment shown in FIGS. 1 and 2. The difference between them is that each boundary detection field is classified in ratio of the target food into three stages, the first lank where the ratio of the target food is zero to less than 30%, the second lank where the ratio of the target food is from 30% to 60%, and the third lank where the ratio of the target food is not less than 60%, and the temperature of the target food 9 is determined based on the temperature of the three stages.

Next, a description will be given of the heating control operation of the heating apparatus for cooking of the fourth embodiment with reference to the flowchart shown in FIGS. 14 and 15.

Figure 14:
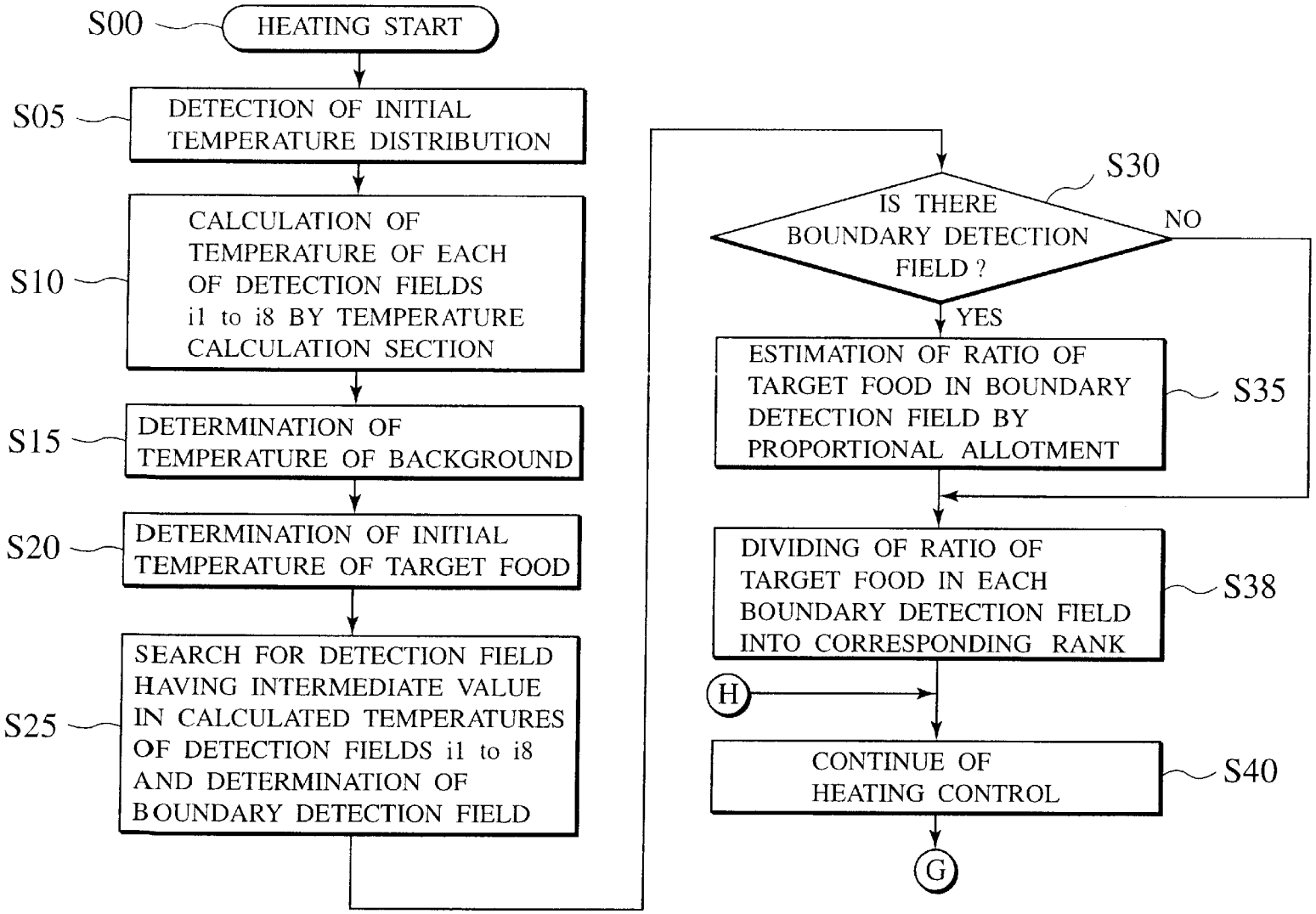
FIG. 14 is a first half of a flowchart showing a control of a thawing and heating process in the heating apparatus for cooking of the fourth embodiment.
Figure 15:
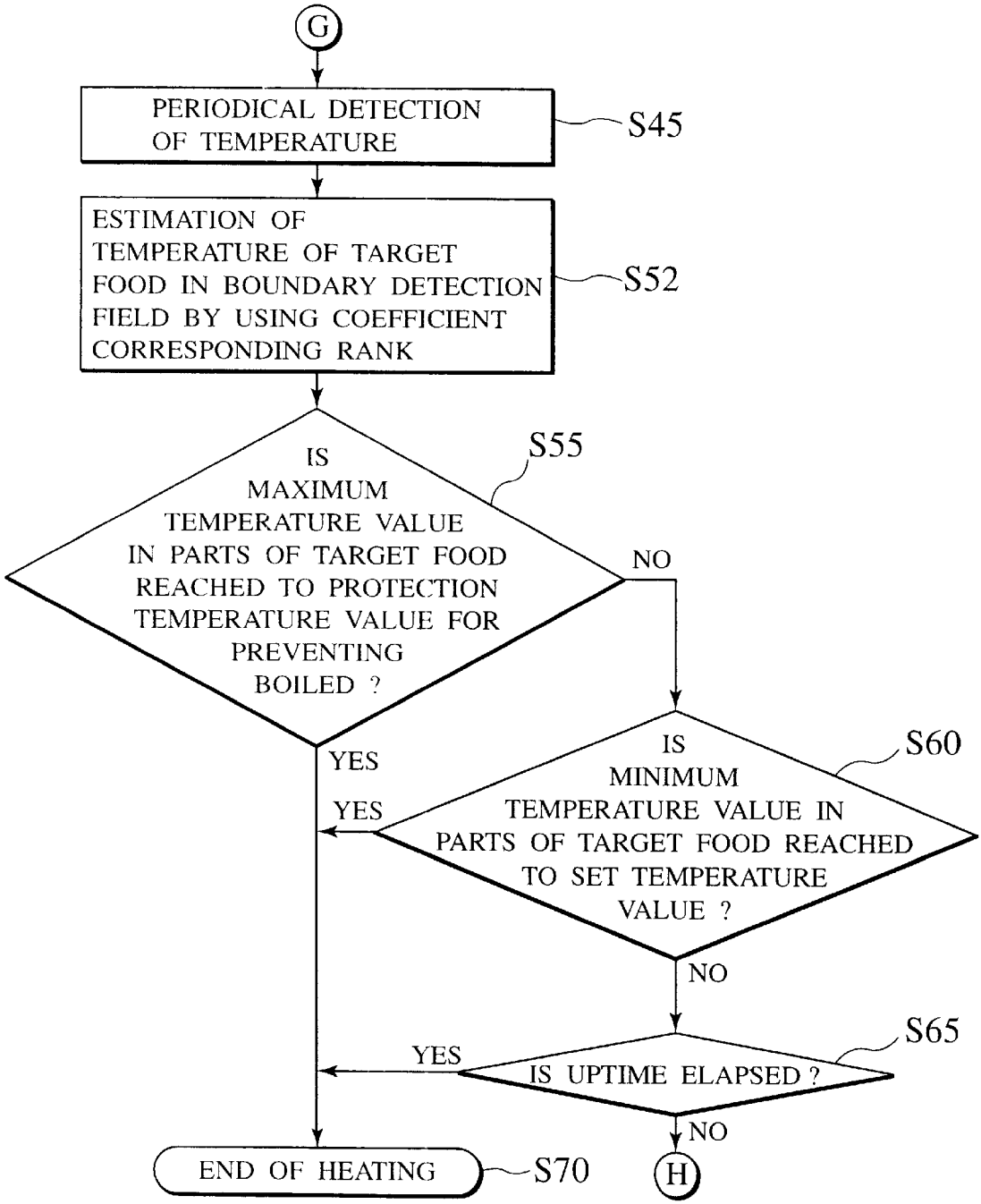
FIG. 15 is a latter half of the flowchart showing the control of the thawing and heating process in the heating apparatus for cooking of the fourth embodiment.

FIG. 14 is the first half of the flowchart showing the control of the thawing and heating process in the heating apparatus for cooking of the fourth embodiment and FIG. 15 is the latter half of the flowchart showing the control of the thawing and heating process in the heating apparatus for cooking of the fourth embodiment.

The operations Steps S05 to S35 in the fourth embodiment after the start button for heating is pushed by the user are the same as those of the heating apparatus for cooking of the first embodiment shown in FIGS. 7 and 8.

Next, the heating apparatus for cooking of the fourth embodiment judges a rank of the ratio of the target food 9 in each boundary detection field, namely, the ratio belongs to one of the first to third ranks (Step S38).

After this judgment operation, the heating process control section 13 continues to control the heating specified by the user (Step S40).

Like the case of the heating apparatus for cooking of the first embodiment, the heating apparatus for cooking of the fourth embodiment periodically performs the detection of the internal temperature of the cavity 2 based on the detection by the IR sensor 8 during the thawing and heating process (Step S45), and the heating process control section 13 checks the temperature of the target food 9 in both the direct detection field and the boundary detection field and estimates the temperature of the target food 9 in thus boundary detection field.

In the fourth embodiment, the estimation of the temperature of the target food 9 in the boundary detection field performs by using a constant coefficient per rank. For example, the constant coefficient Sjrank=⅓ is used for the first rank, Sjrank=½ is used for the second rank, and Sjrank=1 is used for the third rank. When a boundary temperature is 20° C., a temperature of the background field is 25° C., and the rank is the second rank (Sjrank=½, the temperature Tjf=15° C. of the target food 9 can be estimated by the following equation (Step S52).

$$Tjf = \frac{Tjwhl - Tbk + Sjrank \cdot Tbk}{Sjrank} = \frac{20 - 25 + \frac{1}{2} \cdot 25}{\frac{1}{2}} = 15.$$

When the estimated temperature of the part of the target food 9 in one of the direct detection field and the boundary detection field is reached to the protection temperature at which the part of the target food 9 becomes the half-boiled state, the heating process control section 13 stops the heating process (Steps S55 and S70).

On the other hand, even if the temperatures of any part in the target food 9 obtained in both the direct detection field and the boundary detection field are not reached to the protection temperature, the heating is stopped when the calculated temperature (namely, the estimated temperature) is reached to a predetermined temperature value that is lower than the protection temperature and set in advance (Steps S65 and S70). Further, even if the calculated temperature value of any part in the target food 9 are not reached to the predetermined temperature value, the heating is also stopped when the heating time is over the set value of the timer (Steps S65 and S70).

Like the first embodiment, the heating apparatus for cooking of the fourth embodiment can perform the thawing and heating process for a frozen food to be cooked so that the half-boiled state does not occur in any part of the target frozen food while the IR sensor detects the temperature of each part of the target frozen food. Furthermore, in the fourth embodiment, the boundary detection fields are divided into ranks according to the ratio of the target food in each boundary detection field and the temperature of the target food 9 can be estimated by using the coefficients corresponding to the ranks. It is therefore possible to reduce the calculation for the estimation temperature of the target food 9.

In addition, it is possible in the heating apparatus for cooking of the fourth embodiment to use the method of the first embodiment to detect the background temperature and also to use the method of the heating apparatus for cooking of the second embodiment.

Fifth Embodiment

Next, a description will be given of the heating apparatus for cooking of the fifth embodiment.

In the thawing process, it has a significant meaning in coking process whether the temperature of the target food 9 to be cooked is not more than 0° C. or not. When the temperature of the target food 9 is not more than 0° C., the target food 9 is still in a frozen stale and absorbs a small amount of microwave radiation from a magnetron. In the sate that the temperature of the target food 9 is 0° C., the energy of the microwave radiation is used for the state transition of a solid to liquid, namely ice to water. When the temperature of the target food 9 is over 0° C., the water part in the target food 9 is in a liquid state and can absorbs a large amount of the microwave (approximately 80 times when compared with the amount of the absorption of the microwave in the solid state). Accordingly, if there is a half-boiled state in the target food 9, the part of the target food 9 in the half-boiled state absorbs a large amount of the microwave, so that the target food 9 is fallen into a half-boiled state or uneven cooking state.

Because conventional heating apparatus for cooking such as microwave ovens cannot perform a precious temperature detection for any part of the target food, it is impossible to control the heating around the temperature of 0° C.

On the other hand, because the heating apparatus for cooking of the fifth embodiment can preciously detect the temperature of the target food 9 in the boundary detection field in which there are both the background and the part of the target food 9, it is possible to control the heating around the temperature of 0° C. efficiently while checking the temperature of each part of the target food 9.

The configuration of the heating apparatus for cooking according to the fifth embodiment is the same as that of the heating apparatus for cooking of the first embodiment shown in FIGS. 1 and 2. The difference between the fifth embodiment and the first embodiment is that the heating degree is changeable according to the temperature of the target food 9 during the thawing and heating process.

Next, a description will be given of the heating control operation of the heating apparatus for cooking of the fifth embodiment with reference to the flowchart shown in FIGS. 16 and 17.

Figure 16:
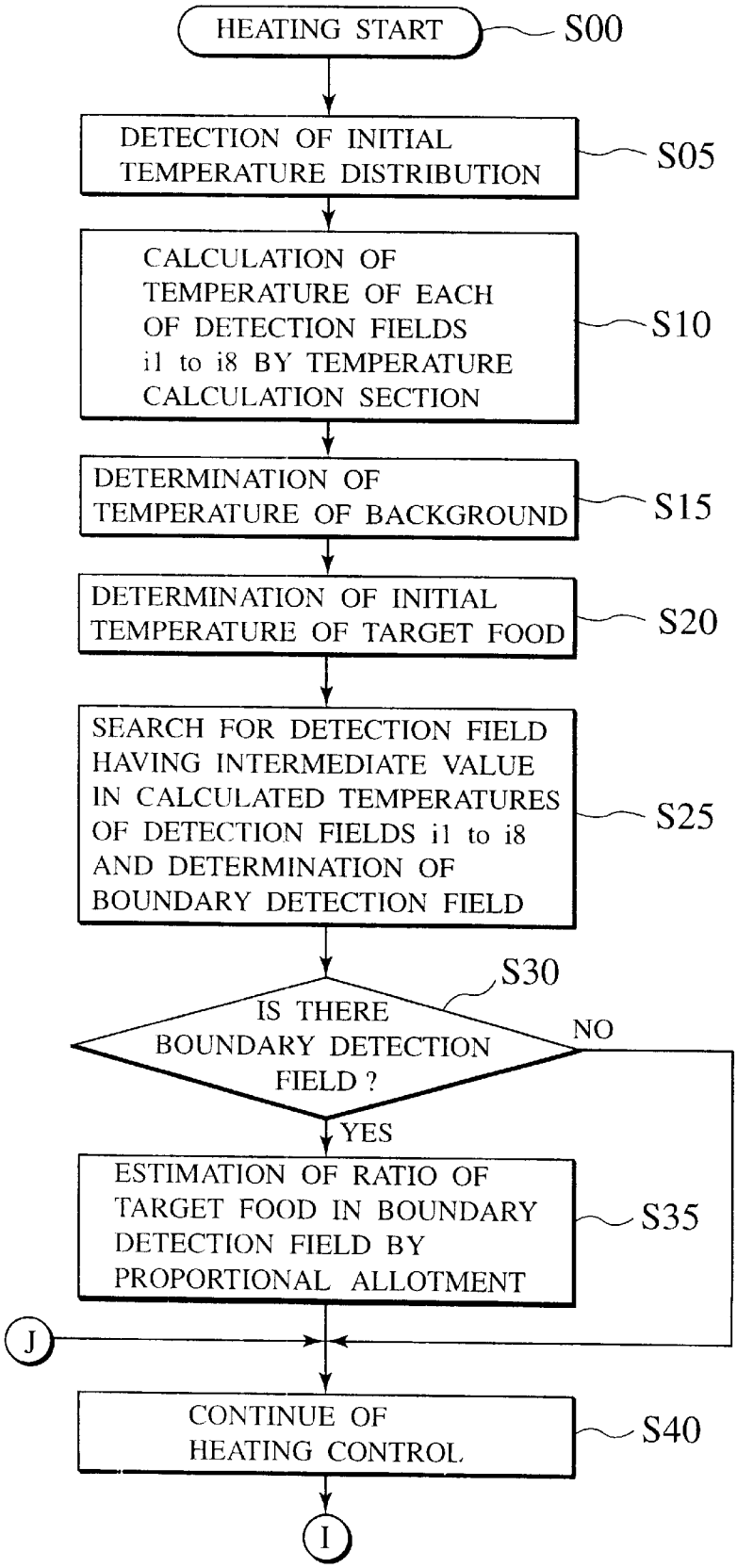
FIG. 16 is a first half of a flowchart showing a control of a thawing and heating process in the heating apparatus for cooking of the fifth embodiment.
Figure 17:
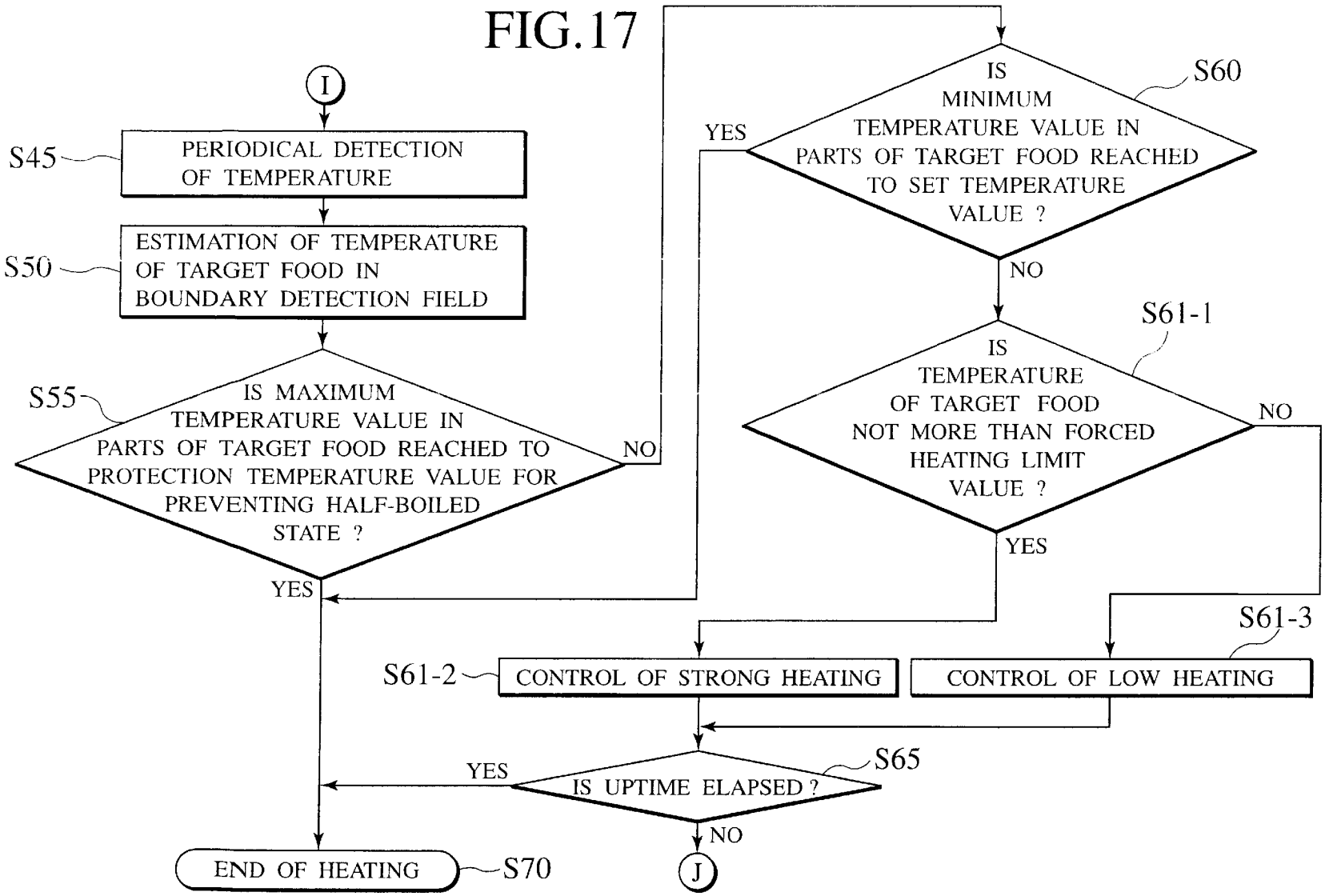
FIG. 17 is a latter half of the flowchart showing the control of the thawing and heating process in the heating apparatus for cooking of the fifth embodiment.

FIG. 16 is the first half of the flowchart showing the control of the thawing and heating process in the heating apparatus for cooking of the fifth embodiment and FIG. 17 is the latter half of the flowchart showing the control of the thawing and heating process in the heating apparatus for cooking of the fifth embodiment.

Hereinafter, the case in which the power supply of the heating apparatus 1 for cooking is ON, the thawing is selected as the cooking process, and the heating start button is pushed by the user will be explained.

The operations (for example, the detection of the initial temperature distribution, the calculation of each of the detection fields i1 to i8, the judgment to judge the type of the detection field, the determination of the boundary detection field, and the calculation of the ratio of the target food in the boundary detection field) shown in Steps S05 to S35 after the heating start button is pushed at Step S00 are the same as those of the first embodiment shown in FIGS. 7 and 8.

After these processes, the heating process control section 13 continues to control the heating to the target food 9 based on the specified heating type (Step S40). Like the heating apparatus for cooking of the first embodiment, the heating apparatus for cooking of the fifth embodiment continues to detect the internal temperature of the cavity 2 periodically (Step S45), the heating process control section 13 checks the temperature of the target food 9 in both the direct detection field and the boundary detection field and estimates the temperature of the target food 9 (Step S50).

When the estimated temperature of the part of the target food 9 in one of the direct detection field and the boundary detection field is reached to the protection temperature at which the part of the target food 9 becomes the half-boiled state, the heating process control section 13 stops the heating process (Steps S55 and S70).

On the other hand, even if the temperatures of any part in the target food 9 obtained in the direct detection field and the boundary detection field are not reached to the protection temperature, the heating is stopped when the calculated temperature (namely, the estimated temperature) is reached to a predetermined temperature value that is lower than the protection temperature and set in advance (Steps S60 and S70). On the contrary, when the calculated temperature value of any part in the target food 9 is not reached to the predetermined temperature value, the operation flow of the heating goes to Step S61-1.

At Step S61-1, it is checked whether one of the temperatures of the target food 9 detected in the direct detection field and the boundary detection field is reached to a forced limit of the heating temperature (for example, the heating temperature of the forced limit is 0° C., or within 1 to 5° C.). When the temperature of any part in the target food 9 is not reached to the forced limit of the heating temperature, a strong heating (the power of the heating is strong) is continued (Step S61-1 and S61-2). On the other hand, when reached, the type of the heating is switched from the forced heating (or a strong heating) to a weak heating (or a low heating as the normal heating) (Step S61-3).

Even if the type of the heating is the strong heating or the weak heating, the operation flow is returned to the Steps S40 until the timer is elapsed in order to continues the operation of the strong heating shown in Steps S40 to S61-1 or S61-2. The heating is then stopped when the predetermined time that is set in advance in the timer is elapsed (Step S65 and S70).

Thereby, like the first embodiment, the heating apparatus for cooking of the fifth embodiment can perform the thawing and heating process while checking the increase of the temperature of any local part in the target food 9 so that the temperature of the target food is not reached to a half-boiled temperature by using the IR sensor 8 when it thaws a frozen food. In addition, the strong heating is performed until the temperature of the target food is reached to the forced limit of the heating temperature such as 0° C., and the type of the heating is switched from the strong heating to the weak heating when reached. Therefore it is possible to prevent occurrence of uneven heating state of the target food and to heat the target food as uniform as possible.

It is also possible in the heating apparatus for cooking of the fifth embodiment to use the method of the first embodiment to detect the background temperature and also to use the method of the heating apparatus for cooking of the second embodiment. Further, it is possible in the heating apparatus for cooking of the fifth embodiment to use the estimation of the temperature of the target food in the first to fourth embodiment described above.

Moreover, in the fifth embodiment described above, the strong heating is stopped when the maximum value of the temperature of any part of the target food is reached to or over the forced limit value of the heating temperature that is set in advance, the present invention is not limited by this limit, for example, it is also possible to use a mean value or the minimum value of the temperature of the target food or a mean value between the maximum value and the minimum value of the temperature of the target food instead of the maximum value of the temperature.

Sixth Embodiment

Next, a description will be given of the heating apparatus for cooking of the sixth embodiment.

In the thawing process, it often happens that the surface of the target food is boiled, but the internal part of the target food is in a half-boiled state because the speed of the thawing of the surface of the target food is fast, but that of the internal part of the target food is slow. Many conventional heating apparatus for cooking such as microwave ovens introduce a pre-cooking period in which a power is temporarily OFF or the magnitude of the power for heating is reduced during the thawing and heating process.

However, there is not the technique of the present invention to detect each part of the target food preciously in the prior art. Accordingly, there is a possibility that the microwave is concentrated into a part of the target food, so that the half-boiled state occurs at the part in the target food when the level of the smooth period is set to a high value. Thereby, it is impossible to set the pre-cooking period to a high value.

On the contrary, it is possible for the heating apparatus for cooking of the present invention to set the pre-heating period to a higher value because the heating apparatus for cooking of the present invention can detect the parts of the target food including the boundary area of the target food preciously.

The heating apparatus for cooking of the sixth embodiment is based on the feature described above. The configuration of the heating apparatus for cooking according to the sixth embodiment is the same as that of the heating apparatus for cooking of the first embodiment shown in FIGS. 1 and 2. The sixth embodiment is different in heating control from the first embodiment.

Next, a description will be given of the heating control operation of the heating apparatus for cooking of the sixth embodiment with reference to the flowchart shown in FIGS. 18 and 19.

Figure 18:
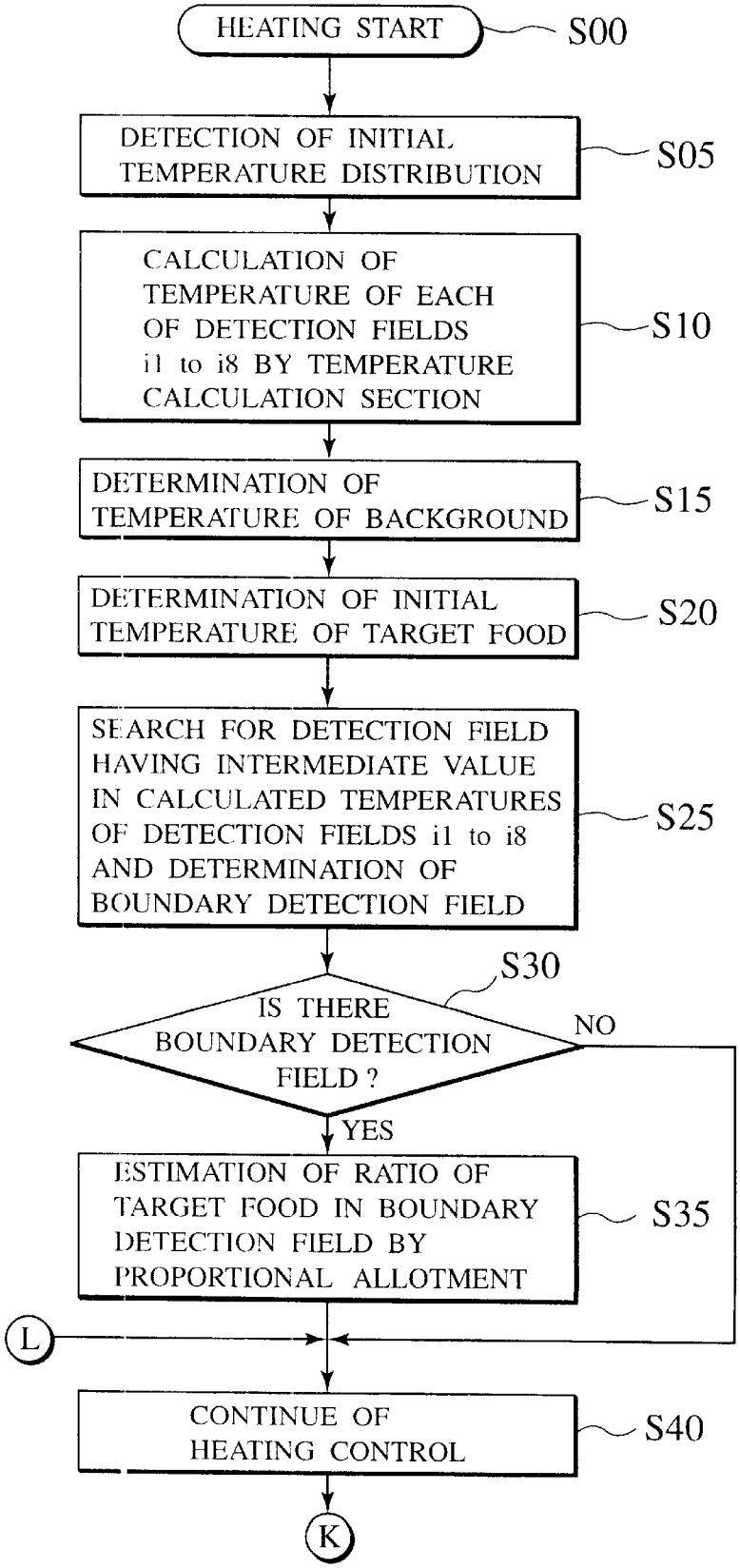
FIG. 18 is a first half of a flowchart showing a control of a thawing and heating process in the heating apparatus for cooking of the sixth embodiment.
Figure 19:
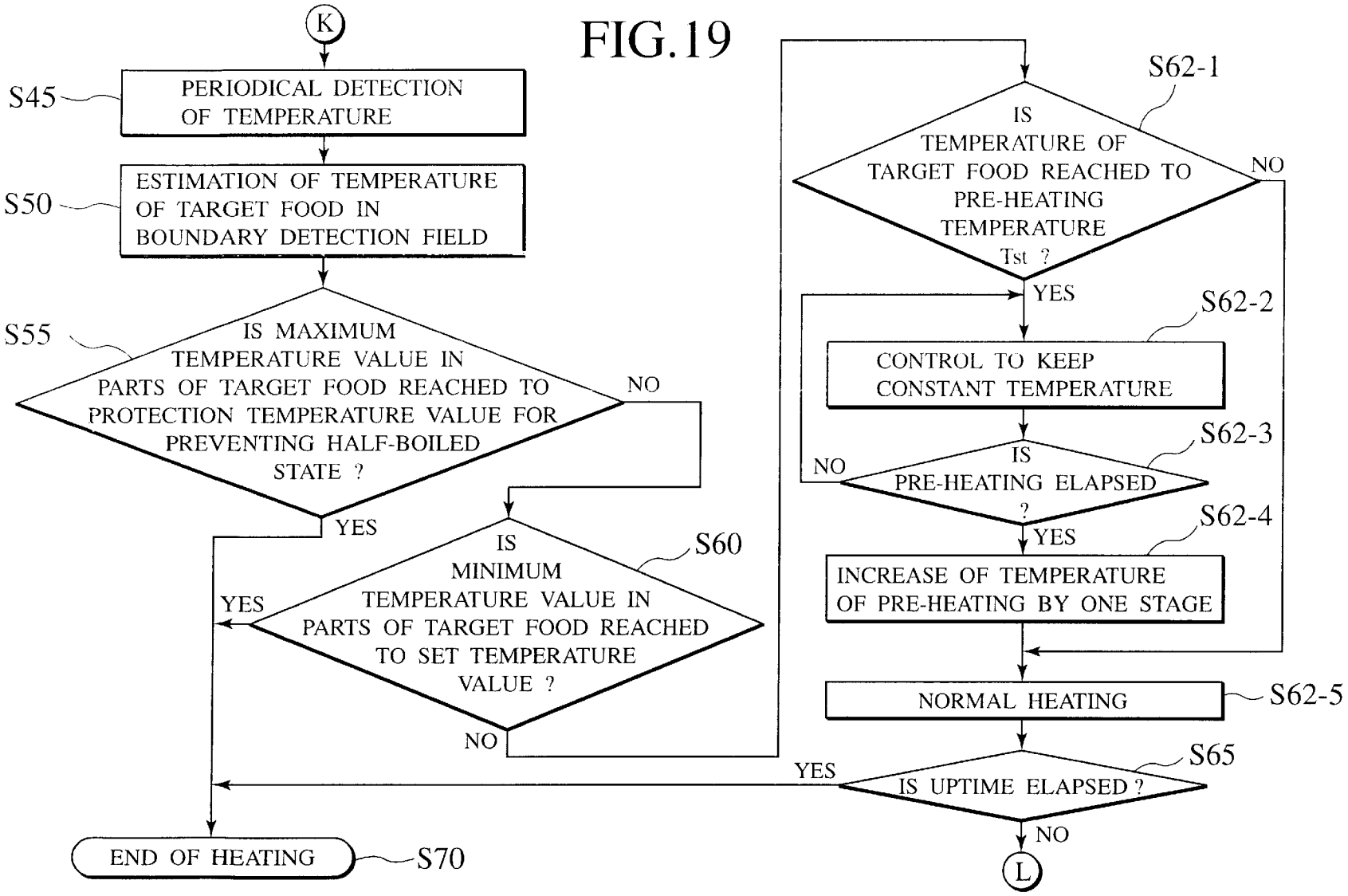
FIG. 19 is a latter half of the flowchart showing the control of the thawing and heating process in the heating apparatus for cooking of the sixth embodiment.

FIG. 18 is the first half of the flowchart showing the control of the thawing and heating process in the heating apparatus for cooking of the sixth embodiment and FIG. 19 is the latter half of the flowchart showing the control of the thawing and heating process in the heating apparatus for cooking of the sixth embodiment.

Hereinafter, the case in which the power supply of the heating apparatus 1 for cooking is ON, the thawing is selected as the cooking process, and the heating start button is pushed by the user will be explained.

After the heating start button is pushed at Step S00 when the power supply of the heating apparatus 1 for cooking is ON (Step S00), the operations (such as the detection of the initial temperature distribution, the temperature calculation for each of the detection fields i1 to i8, the judgment of the type of the detection field, the determination of the boundary detection field, and the calculation of the ratio of the target food in the boundary detection field) shown in Steps S05 to S35 after the power supply of the heating apparatus 1 for cooking is ON (Step S00) are the same as those of the first embodiment shown in FIGS. 7 and 8.

After these processes, the heating process control section 13 continues to control the specified heating manner (Step S40). During the thawing and heating process, the heating apparatus for cooking of the sixth embodiment continues to periodically perform the temperature detection for the internal cavity 2 by the IR sensor 8 (Step S45), like the heating apparatus for cooking of the first embodiment, the heating process control section 13 checks the temperature of the target food 9 in the direct detection field and the boundary detection field, and estimates the temperature of the target food 9 in the boundary detection field based on the prescribed manner (Step S50).

When the estimated temperature of the part of the target food 9 in one of the direct detection field and the boundary detection field is reached to the protection temperature at which the part of the target food 9 becomes the half-boiled state, the heating process control section 13 stops the heating process (Steps S55 and S70).

On the other band, even if the temperatures of any part in the target food 9 obtained in the direct detection field and the boundary detection field are not reached to the protection temperature, the heating is stopped when the calculated temperature is reached to a predetermined temperature value that is lower than the protection temperature and set in advance (Steps S60 and S70). Further, when the calculated temperature values of any part in the target food are not reached to the predetermined temperature value, the operation flow goes to the Step S62-1.

At Step S62-1, it is checked that the maximum temperature of the target food 9 in the direct detection field and the boundary detection field is reached to the initial temperature Tst in pre-heating stages (for example, the value of the initial temperature Tst is 5° C., and the rate of increasing in following each stage is 5° C.). When not reached, the normal heating to the target food 9 is continued (Steps S62-1 and S62-5).

When the temperature of the target food 9 is reached to the initial temperature of the pre-heating Tst by the normal heating, the output of the heating unit 14 is controlled by inverter in order to keep the temperature of the target food 9 at the initial temperature Tst for 1 to 5 minutes, for example (Steps S62-1 and S62-5).

When the time limit for the pre-heating is elapsed, the temperature of the pre-heating is risen by 5° C. corresponding to one stage, and then the target food 9 is heated by the normal heating (Steps S62-4 and S62-5).

The operation flow returns to the Step S40 in order to perform the heating control process from Step S40 to Step S65 unless the time period set in the timer is elapsed (Step S65).

Thereby, like the first embodiment, the heating apparatus for cooking of the sixth embodiment can perform the thawing and heating process while checking the increase of the temperature of any local part in the target food 9 so that the temperature of the target food is not reached to a half-boiled temperature by using the IR sensor when it thaws a frozen food. In addition, the heating apparatus for cooking of the sixth embodiment can perform the pre-heating by setting the temperature for the pre-heating as high as possible that is changeable in stages. Thus, the heating apparatus for cooking of the sixth embodiment is capable of thawing the internal parts the target food as uniform as possible without causing the half-boiled state.

It is also possible in the heating apparatus for cooking of the sixth embodiment to use the method of the first embodiment to detect the background temperature and also to use the method of the heating apparatus for cooking of the second embodiment. Further, it is possible in the heating apparatus for cooking of the sixth embodiment to use the estimation of the temperature of the target food in the first to fifth embodiments described above.

In addition, the pre-heating is performed for a predetermine time period in the sixth embodiment when the maximum value in the detected temperatures of the parts of the target food 9 is reached to the temperature value of the pre-heating, the present invention is not limited by this embodiment, for example, it is possible to use the mean value or the minimum value of the temperature of the parts in the target food or to use the mean value of both the maximum value and the minimum value of the temperatures of the parts in the target food instead of the maximum value.

Seventh Embodiment

Next, a description will be given of the heating apparatus for cooking of the seventh embodiment. The configuration of the heating apparatus for cooking according to the seventh embodiment is the same as that of the heating apparatus for cooking of the first embodiment shown in FIGS. 1 and 2. The seventh embodiment is different in heating control from the first embodiment. That is, in the seventh embodiment, the power of the heating is decreased temporarily when the difference between the maximum value and the minimum value in the temperatures of the parts in the target food is over a predetermined value, and when the difference becomes zero, the normal heating is continued until the temperature of the target food is reached to a target temperature that is set in advance.

Figure 20:
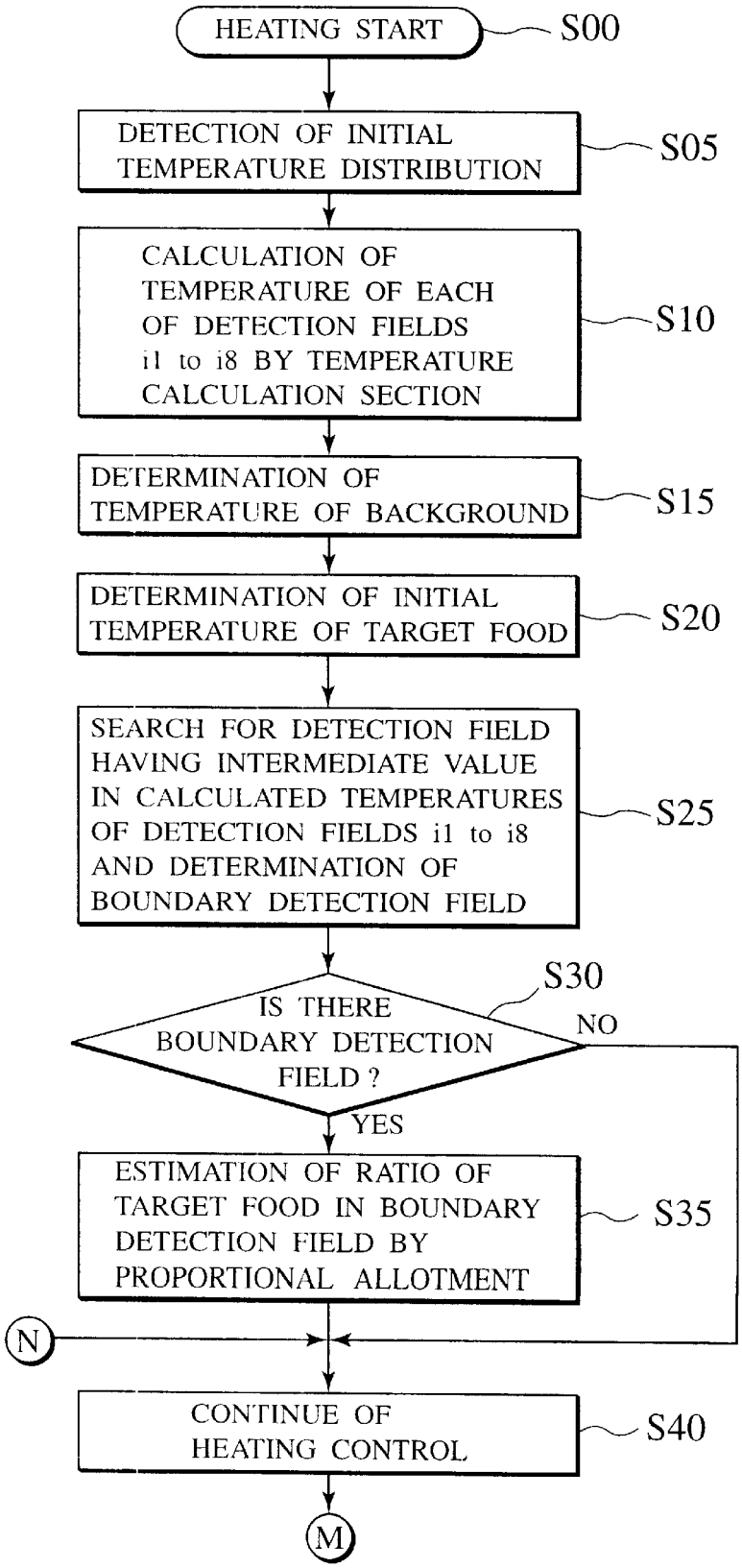
FIG. 20 is a first half of a flowchart showing a control of a thawing and heating process in the heating apparatus for cooking of the seventh embodiment.
Figure 21:
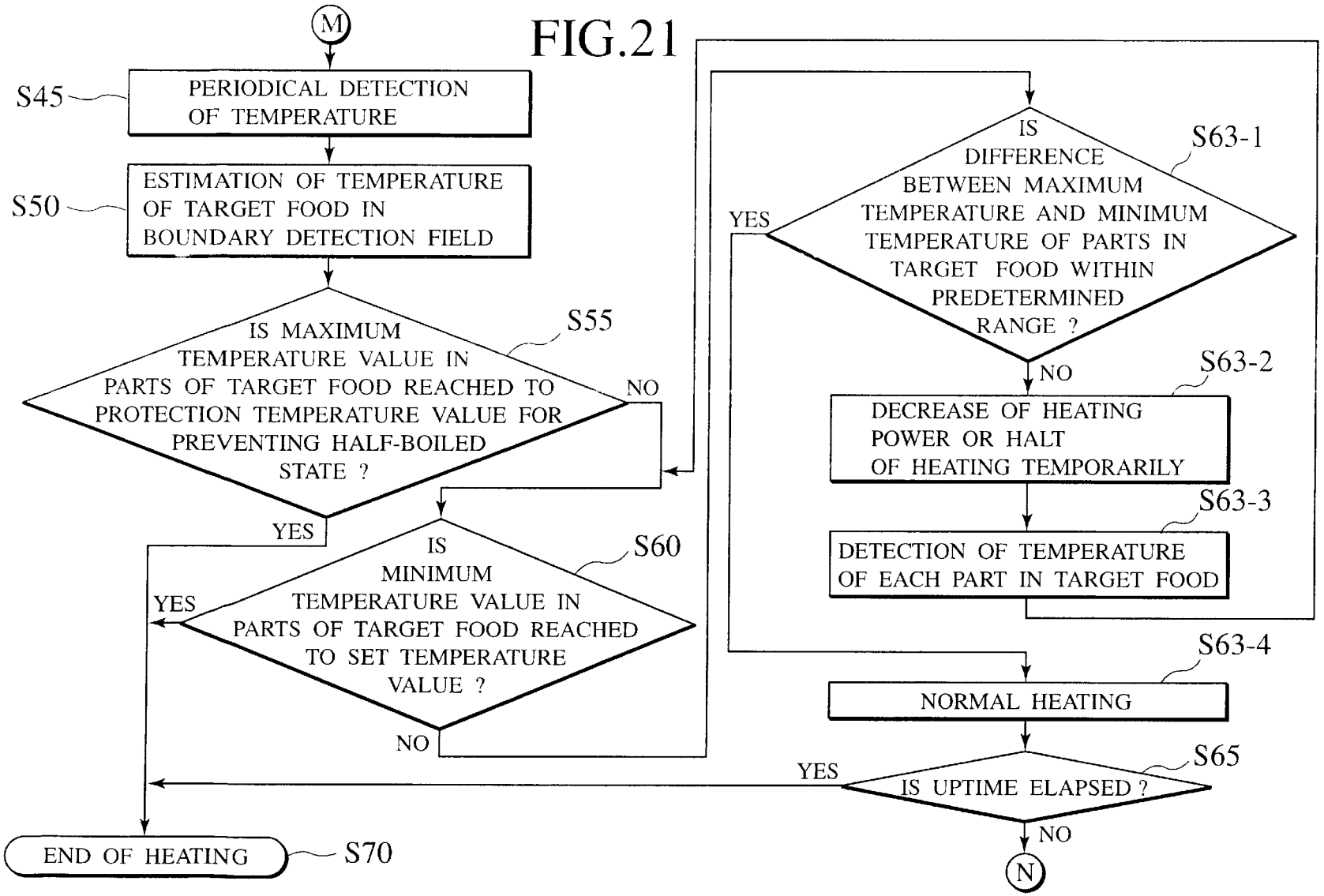
FIG. 21 is a latter half of the flowchart showing the control of the thawing and heating process in the heating apparatus for cooking of the seventh embodiment.

Next, a description will be given of the heating control operation of the heating apparatus for cooking of the seventh embodiment with reference to the flowchart shown in FIGS. 20 and 21. FIG. 20 is the first half of the flowchart showing the control of a thawing and heating process in the heating apparatus for cooking of the seventh embodiment and FIG. 21 is the latter half of the flowchart showing the control of the thawing and heating process in the heating apparatus for cooking of the seventh embodiment.

Hereinafter, the case in which the power supply of the heating apparatus 1 for cooking is ON, the thawing is selected as the cooking process, and the heating start button is pushed by the user will be explained.

After the power supply of the heating apparatus 1 for cooking is ON (Step S00) and the heating start button is pushed by the user shown at Step S00, the operations (such as the detection of the initial temperature distribution, the temperature calculation for each of the detection fields i1 to i8, the judgment of the type of the detection field, the determination of the boundary detection field, and the calculation of the ratio of the target food in the boundary detection field) shown in Steps S05 to S35 after the power supply of the heating apparatus 1 for cooking is ON (Step S00) are the same as those of the first embodiment shown in FIGS. 7 and 8.

After these processes, the heating process control section 13 continues to control the specified heating manner(Step S40). During the thawing anal heating process, the heating apparatus for cooking of the seventh embodiment continues to periodically perform the temperature detection for the internal cavity 2 by the IR sensor 8 (Step S45), like the heating apparatus for cooking of the first embodiment, the heating process control section 13 checks the temperature of the target food 9 in the direct detection field and the boundary detection field, and estimates the temperature of the target food 9 in the boundary detection field based on the prescribed manner (Step S50).

When the estimated temperature of the part of the target food 9 in one of the direct detection field and the boundary detection field is reached to the protection temperature at which the part of the target food 9 becomes the half-boiled state, the heating process control section 13 stops the heating process (Steps S55 and S70).

On the other hand, even if the temperatures of any part in the target food 9 obtained in the direct detection field and the boundary detection field are not reached to the protection temperature, the heating is stopped when the calculated temperature is reached to a predetermined temperature value that is lower than the protection temperature and set in advance (Steps S60 and S70). Further, the operation flow goes to Step S63-1 when the calculated temperature value is not reached to the predetermined temperature value.

At Step 63-1, the difference between the maximum value and the minimum value, in the temperature of the parts in the target food 9 is calculated and it is checked whether or not the difference is within a temperature range of 3° C. to 10° C. in order to check whether the parts of the target food are heated uniformly.

When the difference is in the temperature range of 3° C. to 5° C. at Step S63-1, it may be recognized that the target food is heated uniformly and then the normal heating is performed (Step S63-4).

On the other hand, when the difference is not in the temperature range of 3° C. to 5° C., the heating power is decreased or the heating is halted temporality under the inverter control until the temperature of any part in the target food enters the temperature range (Step S63-2 and S63-3). When the difference of the temperature enters the temperature range, the normal heating is restarted (Steps S60, S63-1, and S63-4).

During the normal heating, the processes Steps S40 to S65 is repeated (Step S65) until the time period designated by the timer is elapsed.

Thereby, like the first embodiment, the heating apparatus for cooking of the seventh embodiment can perform the thawing and heating process while checking the increase of the temperature of any local part in the target food 9 so that the temperature of the target food is not reached to a half-boiled temperature by using the IR sensor when it thaws a frozen food. In addition, the heating apparatus for cooking of the seventh embodiment can perform the heating control in which the heating power is decreased or the heating is halted temporary until the difference enters the temperature range when the difference of the temperature of the parts in the target food is not within the temperature ranges while checking the temperatures of the parts in the target food. Then, the normal heating is performed after the difference enters the temperature range. Accordingly it is possible to thaw the internal parts in the target food uniformly.

Further, it is also possible in the heating apparatus for cooking of the seventh embodiment to use the method of the first embodiment to detect the background temperature and also to use the method of the heating apparatus for cooking of the second embodiment. Further, it is possible in the heating apparatus for cooking of the seventh embodiment to use the estimation of the temperature of the target food in the first to sixth embodiment described above.

Eighth Embodiment

Next, a description will be given of the heating apparatus for cooking of the eighth embodiment. The configuration of the heating apparatus for cooking according to the eighth embodiment is the same as that of the heating apparatus for cooking of the first embodiment shown in FIGS. 1 and 2. The eighth embodiment is different in heating control from the first embodiment. That is, in the eighth embodiment, the thawing process is halted according to the detection result of the initial temperature of the background and a warning is given to the user.

Figure 22:
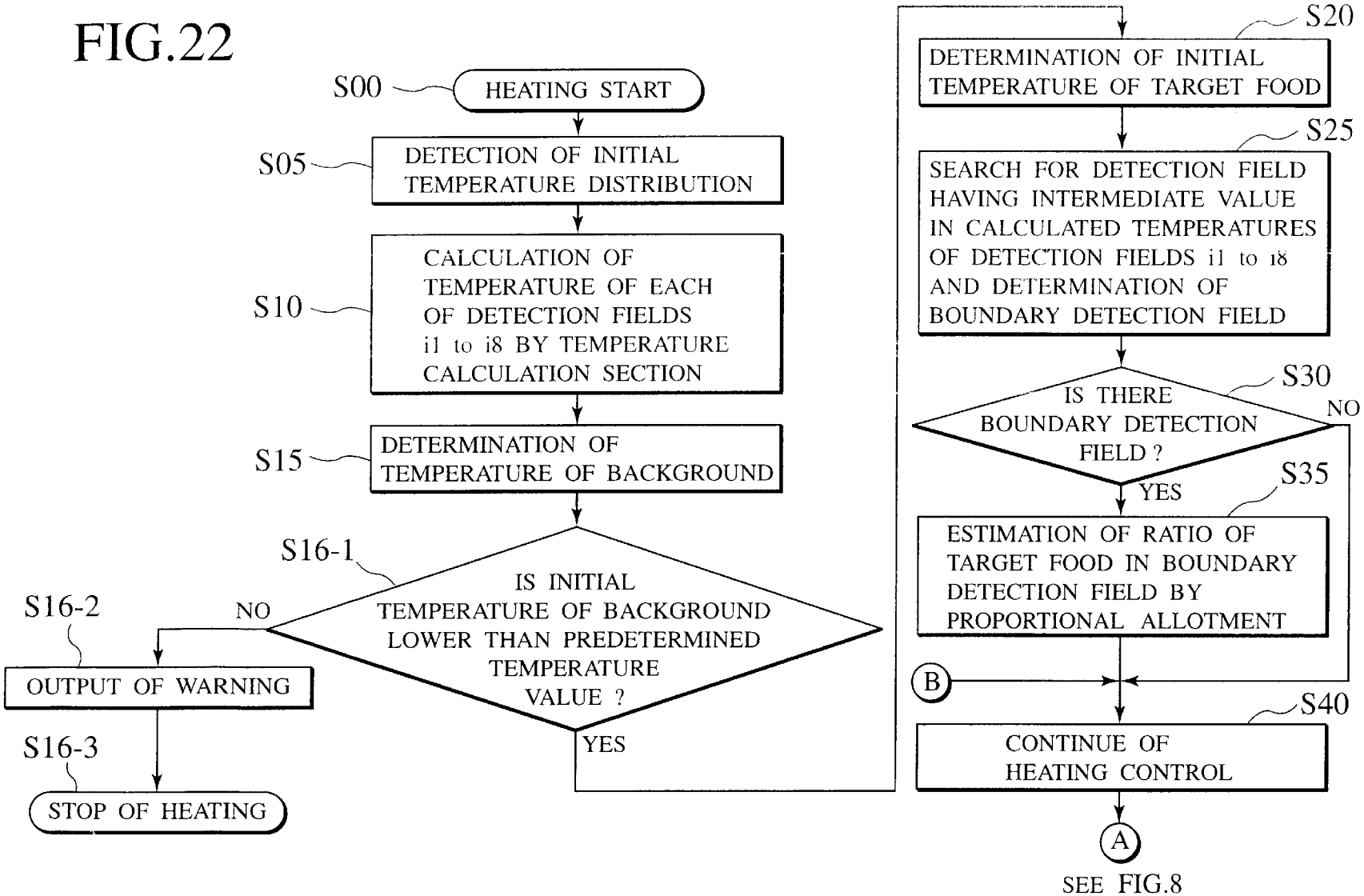
FIG. 22 is a flowchart showing a control of a thawing and heating process in the heating apparatus for cooking of the eighth embodiment.

Next, a description will be given of the heating control operation of the heating apparatus for cooking of the eighth embodiment with reference to the flowchart shown in FIG. 22. FIG. 22 is the flowchart showing the control of the thawing and heating process in the heating apparatus for cooking of the eighth embodiment.

Hereinafter, the case in which the power supply of the heating apparatus 1 for cooking is ON, the thawing is selected as the cooking process, and the heating start button is pushed by the user will be explained.

After the heating start button is pushed at Step SOO when the power supply of the heating apparatus 1 for cooking is ON and the heating is started during the time period that is set in the timer in advance (Step S00). The IR sensor 8 detects the initial temperature distribution of the cavity 2 that is performed in parallel to the above heating and outputs the detection results to the temperature calculation section 11. The self-temperature detection signal is also output to the temperature calculation section 11 (Step S05). That is, the temperature calculation section 11 calculates the temperature calculation based on the temperature detection signals from the linear element in the IR sensor 8 corresponding to the detection fields i1 to i8. The temperature calculation section 11 also calculates the self-temperature (as a standard temperature) (Step S10) and calculates the background temperature based on the output signal from the self-temperature sensor (Step S15).

The heating process control section 13 compares the initial temperature of the background with an upper limit value (for example 120° C. that is determined based on a heat-resistance characteristic of the IR sensor 8) that is set in advance. When the initial temperature of the background detected is over the upper limit value, the heating apparatus for cooking of the eighth embodiment sounds a beep as a warning to the user and informs or displays a warning information "The thawing can not be started because the temperature of the cavity is high. Please use it after the cavity is cold." on the operation panel 4 (Step S16-2) to the user, and the heating is forcefully stopped (Step S16-3).

However, when the initial temperature of the background is lower than the predetermined upper limit in the comparison at Step S16-1, the healing apparatus for cooking continues the control of the thawing and heating process in order to perform the operations Steps S20 to S70, like the heating apparatus for cooking of the first embodiment shown in FIGS. 7 and 8.

Thereby, the heating apparatus for cooking of the eighth embodiment can halt the thawing forcefully when the temperature of the cavity 2 is abnormally high in the case that the thawing is started after the heating apparatus for cooking was used as oven. Therefore it is possible to avoid the occurrence that a correct detection of the temperature cannot be performed by a malfunction of the IR sensor 8.

In the heating apparatus for cooking of the eighth embodiment, the warning is given to the user for user-friendly when the thawing is halted, the present invention is limited by this case, for example, it is possible to halt the thawing without the warning or to give the warning to the user without halting the thawing.

Further, it is also possible in the heating apparatus for cooking of the eighth embodiment to use the method of the first embodiment to detect the background temperature and also to use the method of the heating apparatus for cooking of the second embodiment.

Ninth Embodiment

Next, a description will be given of the heating apparatus for cooking of the ninth embodiment. The configuration of the heating apparatus for cooking according to the ninth embodiment is the same as that of the heating apparatus for cooking of the first embodiment shown in FIGS. 1 and 2. The feature of the ninth embodiment is that the power of the thawing and heating process is decreased according to the detection result of the initial temperature of the background.

When the frozen target food to be cooked is placed on the tray 10 in the cavity 2 in the thawing and the temperature of the cavity 2 is sufficiently high, the thawing is proceeded spontaneously without any heating. In this case, there is a possibility to occur the over-heating when the normal heating is performed. In order to avoid this possibility, the power of the heating is decreased.

Figure 23:
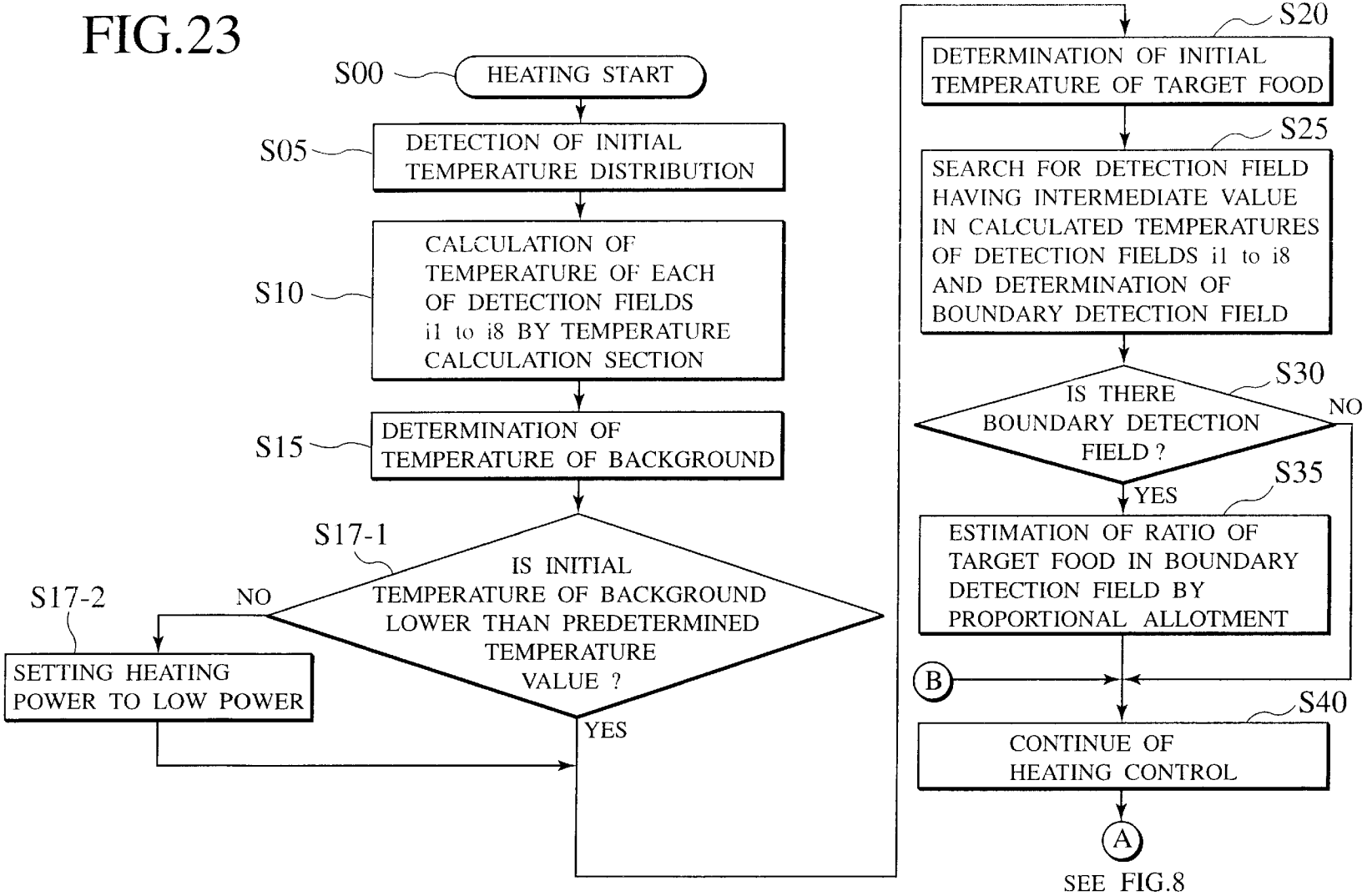
FIG. 23 is a flowchart showing a control of a thawing and heating process in the heating apparatus for cooking of the ninth embodiment.

Next, a description will be given of the heating control operation of the heating apparatus for cooking of the ninth embodiment with reference to the flowchart shown in FIG. 23. FIG. 23 is the flowchart showing the control of the thawing and heating process in the heating apparatus for cooking of the ninth embodiment.

Hereinafter, the case in which the thawing is selected as the cooking process and the heating start button is pushed will be explained. After the power supply of the heating apparatus 1 for cooking is ON and the heating start button is pushed by the user shown at Step S00, the heating is started during the time period designated in the timer (Step S00), like the first embodiment shown in FIG. 7.

The IR sensor 8 detects the initial temperature distribution of the cavity 2. The detection is performed in parallel to the above heating. The IR sensor 8 outputs the detection results to the temperature calculation section 11. The self-temperature detection signal is also output to the temperature calculation section 11 (Step S05). That is, the temperature calculation section 11 performs the temperature calculation based on the temperature detection signals from the linear elements in the IR sensor 8 corresponding to the detection fields i1 to i8. The temperature calculation section 11 also calculates the self-temperature (as a standard temperature) (Step S10) and calculates the background temperature based on the output signal from the self-temperature sensor (Step S15).

Then, the heating process control section 13 compares the initial temperature of the back ground with a predetermined value, for example 50° C. When the initial temperature of the background is over the predetermined value, the heating power is decreased to a low power such as ⅕ to ½ of the normal power for heating (Steps S17-1 and S17-2). When does not over, the normal power is used for heating without the decreasing the heating power.

The following control operations in the thawing and heating process shown in Steps S20 to S70 are performed like the heating apparatus for cooking as the first embodiment shown in FIGS. 7 and 8.

When the heating power is decreased at Step S17-2, the low heating power is continuously used in the control operations at Step S20 and after Step 20.

Thereby, when the thawing is performed immediately following the use of the heating apparatus as oven and the temperature of the cavity 2 is thereby high, there is a possibility that the target food becomes a half-boiled state because the thawing of the target food can be naturally progressed without any heating. In the heating apparatus for cooking of the ninth embodiment, the heating power can be decreased in the above case in order to perform the thawing and heating process without any occurrence of the half-boiled state.

Further, it is also possible in the heating apparatus for cooking of the ninth embodiment to use the method of the first embodiment to detect the background temperature and also to use the method of the heating apparatus for cooking of the second embodiment.

Tenth Embodiment

Next, a description will be given of the heating apparatus for cooking of the tenth embodiment. The configuration of the heating apparatus for cooking according to the tenth embodiment is the same as that of the heating apparatus for cooking of the first embodiment shown in FIGS. 1 and 2.

The feature of the tenth embodiment is that the heating power of the thawing and heating process is switched according to the temperature of the target food detected at the start of the thawing and heating process. That is, when the target food in a frozen state whose temperature is not more than −20° C., it is necessary to use a high heating power that is higher than that of the normal heating in order to perform a rapid thawing. On the other hand, when the target food in the frozen state whose temperature is 0° C., it is better to use the normal heating power because a liquid or a water can absorbs a large amount of the microwave rather than a solid frozen state such as an ice and there is a possibility that the liquid part in the target food of 0° C. becomes the half-boiled state.

The heating apparatus for cooking of the tenth embodiment is capable of controlling the heating power according to the initial temperature of the target food 9.

Figure 24:
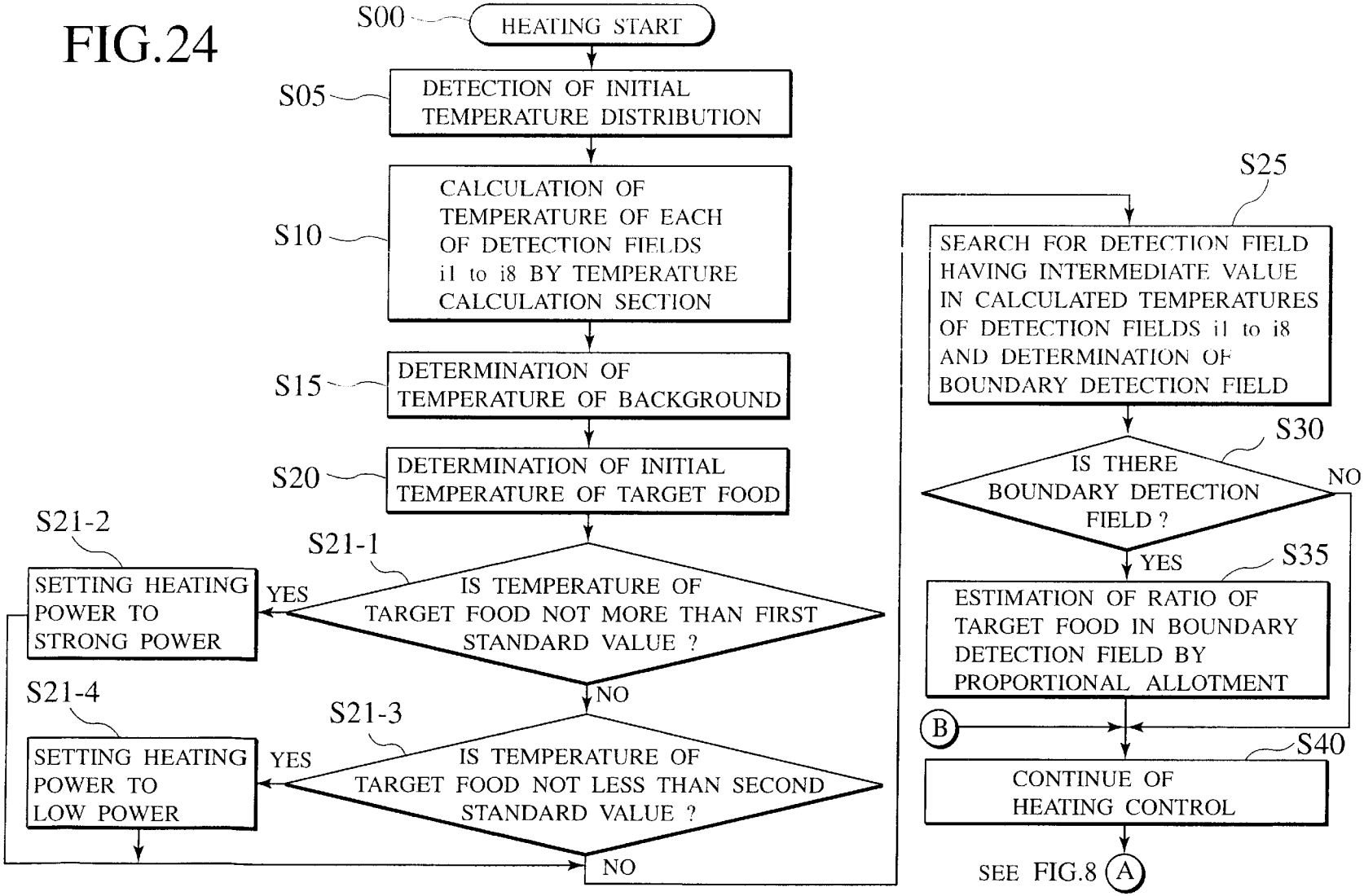
FIG. 24 is a flowchart showing a control of a thawing and heating process in the heating apparatus for cooking of the tenth embodiment.

Next, a description will be given of the heating control operation of the heating apparatus for cooking of the tenth embodiment with reference to the flowchart shown in FIG. 24. FIG. 24 is the flowchart showing the control of the thawing and heating process in the heating apparatus for cooking of the ninth embodiment.

Hereinafter, the case in which the thawing is selected as the cooking process and the heating start button is pushed by the user will be explained. After the power supply of the heating apparatus 1 for cooking is ON and the heating start button is pushed by the user shown at Step S00, the heating is started during the time period set in the timer (Step S00), like the first embodiment shown in FIG. 7.

The IR sensor 8 detects the initial temperature distribution of the cavity 2 which is performed in parallel to the above heating and outputs the detection results to the temperature calculation section 11. The self temperature detection signal is also output to the temperature calculation section 11 (Step S05).

That is, the temperature calculation section 11 performs the temperature calculation based on the temperature detection signals from the linear elements in the IR sensor 8 corresponding to the detection fields i1 to i8. The temperature calculation section 11 also calculates the self-temperature (as a standard temperature) (Step S10) and calculates the background temperature based on the output signal from the self-temperature sensor (Step S15), and obtains the initial temperature of the target food 9 based on the minimum temperature value in the calculated temperature values (Step S20).

The heating process control section 13 sets the heating power to the strong heating power that is greater than that of the normal heating power based on the initial temperature of the target food 9 when the initial temperature of the target food 9 is lower than the first standard value T1 (for example, −20° C.) (Steps S21-1 and S21-2).

When the initial temperature of the target food 9 is not less than the second standard value T2 (for example, 0° C.), the heating process control section 13 sets the heating power to the low heating power that is lower than that of the normal heating power (Steps S21-3 and S21-4). On the other hand, When the initial temperature of the target food 9 is within the range of 0° C. to −20° C. (T1–T2), the heating process control section 13 sets the heating power to the normal heating power.

The following control operations in the thawing and heating process after Step S25 are performed like the heating apparatus for cooking as the first embodiment shown in FIGS. 7 and 8.

Thereby, the heating apparatus for cooking of the tenth embodiment is capable of reducing a time period that is necessary for the thawing and heating process by switching the heating power according to the initial temperature of the target food 9 detected at the start time of the thawing and heating process, and of performing the thawing of the target food uniformly without causing the half-boiled state in any part in the target food 9.

Further, it is also possible in the heating apparatus for cooking of the tenth embodiment to use the method of the first embodiment to detect the background temperature and also to use the method of the heating apparatus for cooking of the second embodiment.

Further, although the heating power is switched in the strong heating power, the normal heating power, and the low heating power according to the initial temperature value of the target food 9 in the above description, it is also possible to switch the heating power according to the temperature of the target food during the thawing and heating process in addition to the switching of the heating power at the initial temperature of the target food 9.

Eleventh Embodiment

Next, a description will be given of the heating apparatus for cooking of the eleventh embodiment.

The feature of the eleventh embodiment is that no heating is performed and stops the heating and informs a warning to user or gives a voice in formation to the users when the initial temperature of the target food 9 is higher than a predetermined temperature value.

The configuration of the heating apparatus for cooking according to the eleventh embodiment is the same as that of the heating apparatus for cooking of the first embodiment shown in FIGS. 1 and 2.

Figure 25:
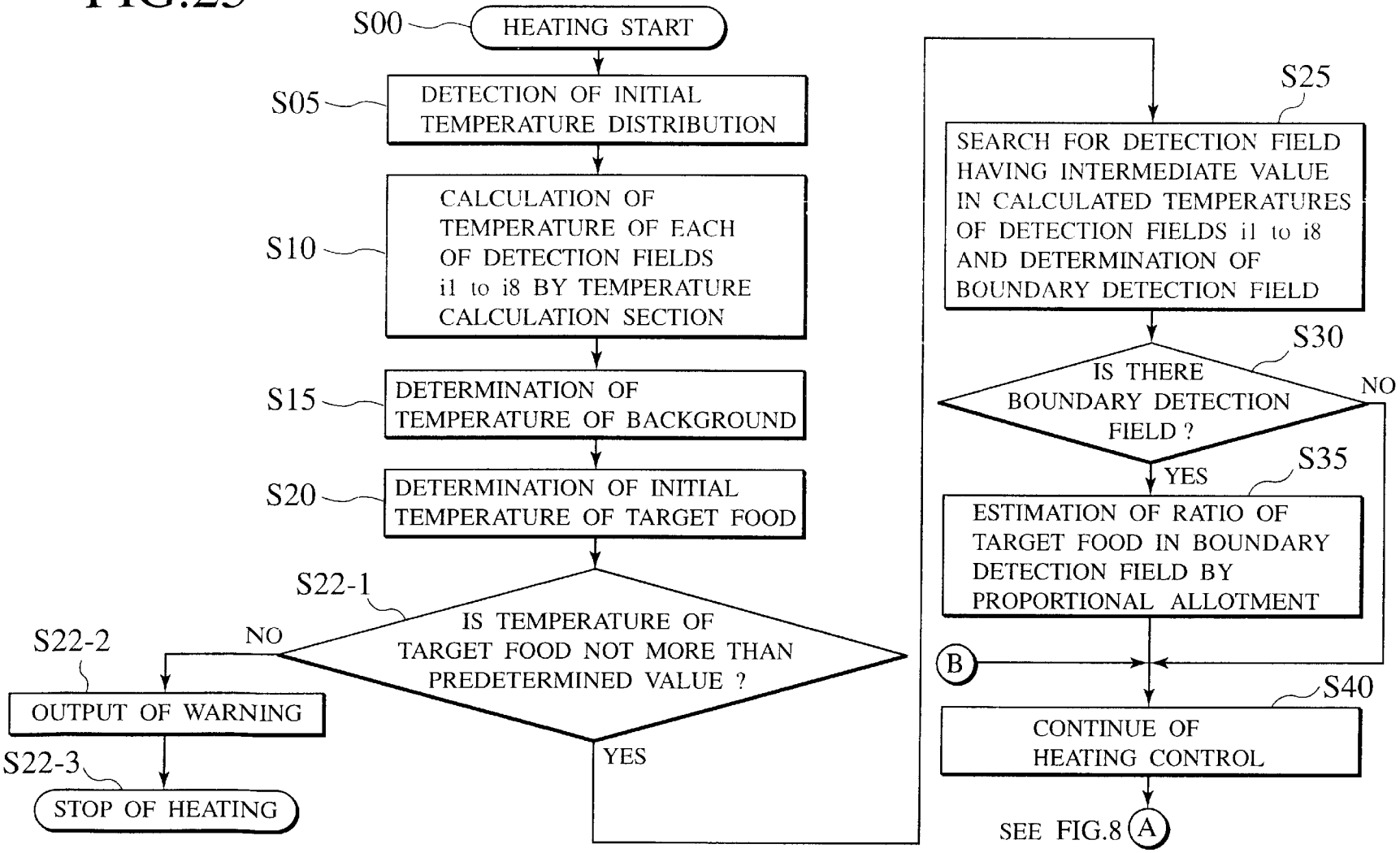
FIG. 25 is a flowchart showing a control of a thawing and heating process in the heating apparatus for cooking of the eleventh embodiment.

Next, a description will be given of the heating control operation of the heating apparatus for cooking of the eleventh embodiment with reference to the flowchart shown in FIG. 25. FIG. 25 is the flowchart showing the control of the thawing and heating process in the heating apparatus for cooking of the eleventh embodiment.

Hereinafter, the case in which the thawing is selected as the cooking process and the heating start button is pushed will be explained. After the power supply of the heating apparatus 1 for cooking is ON and the heating start button is pushed by the user shown at Step S00, the heating is started during the time period that is set in advance in the timer (Step S00), like the first embodiment shown in FIG. 7.

The IR sensor 8 detects the initial temperature distribution of the cavity 2 which is performed in parallel to the above heating and outputs the detection results to the temperature calculation section 11. The self temperature detection signal is also output to the temperature calculation section 11 (Step S05).

That is, the temperature calculation section 11 performs the temperature calculation based on the temperature detection signals from the linear elements in the IR sensor 8 corresponding to the detection fields i1 to i8. The temperature calculation section 11 also calculates the self-temperature (as a standard temperature) (Step S10) and calculates the background temperature based on the output signal from the self-temperature sensor (Step S15), and obtains the initial temperature of the target food 9 based on the minimum temperature value in the calculated temperature values (Step S20).

The heating process control section 13 compares the initial temperature of the target food 9 with a predetermined temperature value (for example 10° C. that is set in advance). When the comparison result of Step S22-1 indicates that the initial temperature of the target food 9 is not less than the predetermined temperature value, the heating process control section 13 informs to the user that the thawing for the target food is not performed or gives a voice information, and forcedly stops the heating (Steps S22-1 to S22-3).

On the other hand, when the comparison result of Step S22-1 indicates that the initial temperature of the target food 9 is lower than the predetermined temperature value, the heating process control section 13 performs the normal thawing and heating process. In this case, the heating process control section 13 performs the operation of Steps S25 to S70, like the heating apparatus for cooking of the first embodiment shown in FIGS. 7 and 8.

The heating apparatus for cooking of the eleventh embodiment is capable of preventing to perform unnecessary thawing because the thawing, namely heating, is stopped and the heating process control section 13 gives the information to the user or gives the voice information to the user when the initial temperature of the target food 9 is higher than the predetermined temperature value during the thawing for the target food 9.

Although the heating apparatus for cooking of the eleventh embodiment gives the warning when the heating is forcedly stopped for user-friendly, the present invention is not limited by this, for example, it is possible to perform the stop of heating without any warning to the user, or to give only the warning without forcedly stopping the, heating.

Further, it is also possible in the heating apparatus for cooking of the eleventh embodiment to use the method of the first embodiment to detect the background temperature and also to use the method of the heating apparatus for cooking of the second embodiment.

Figure 26A:
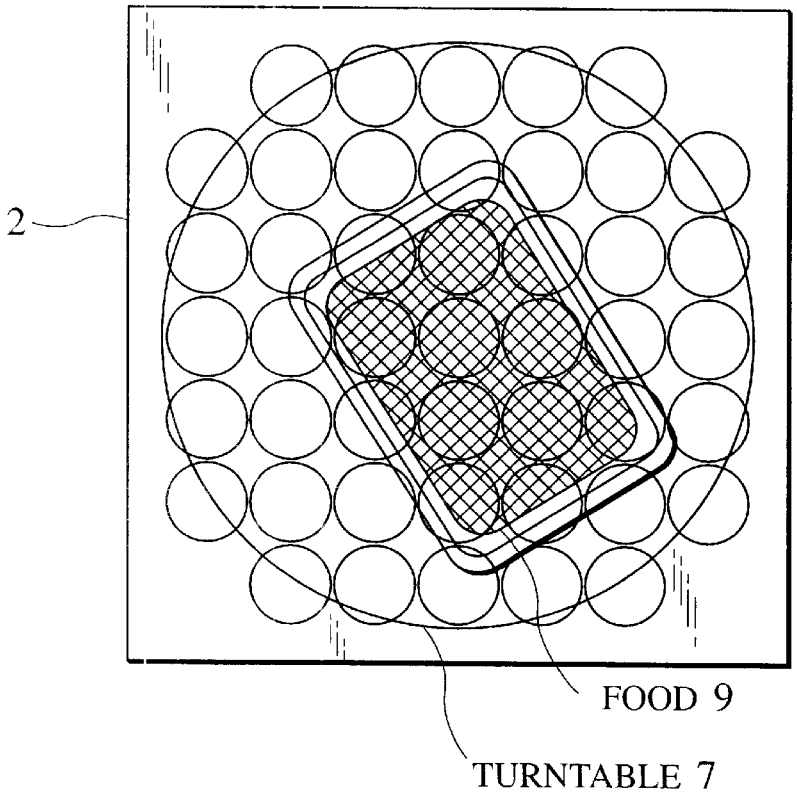
FIGS. 26A and 26B are diagrams showing IR sensors having different configurations of detection fields.
Figure 26B:
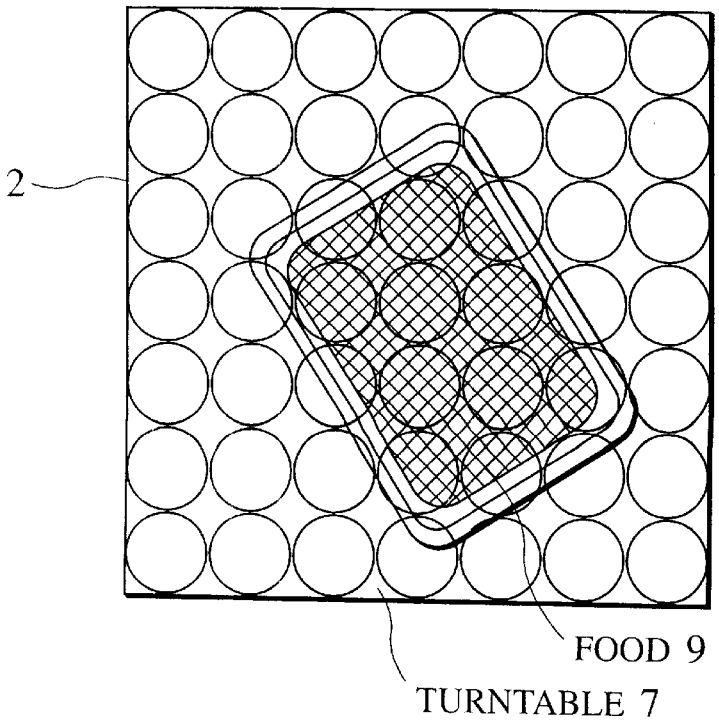

Furthermore, the IR sensor 8 made up of the linear elements i1 to i8 is used in the first to eleventh embodiments described above. However, the present invention is not limited by this configuration. For example, it is possible to use the IR sensor having the configurations shown in FIG. 26A and FIG. 26B. FIGS. 26A and 26B are the diagrams showing the configurations of the IR sensor having different detection fields. For example, as shown in FIG. 26A, the elements in the IR sensor are arranged in a circular shape so that the detection fields of the elements cover the entire of the turntable 7 (almost a circular shape) in the cavity 2, or, as shown in FIG. 26B, the elements are placed in a square shape so that the elements cover the entire of the bottom (almost a square shape) of the cavity 2. These configurations of the elements in the IR sensor can be determined experimentally based on the performance and characteristic of inverter control or the specification of the heating apparatus for cooking.

As set forth in detail, according to the present invention, the heating apparatus for cooking is capable of detecting the direct detection field (area), the boundary detection field (area), and the background detection field (area) and heating a target food to be cooked based on the detected temperature values detected in the direct detection field, the boundary detection field, and the background detection field. Thereby, it is possible to preciously heat the heating for the target food according to the user's selection.

In addition to the above feature according to the present invention, the background temperature detection means detects the temperature of the background during heating process for the target food, and the target food temperature calculation means calculates the calculated temperature values of the target food in the direct detection field and the boundary detection field by the IR detection means. Thereby, it is possible to preciously heat the heating for the target food based on the detected temperature values according to the user's selection.

In addition to the above features according to the present invention, the background temperature detection means calculates the temperature of the background based on a detection result of the self-temperature detection means incorporated in the IR detection means. It is possible to reduce a manufacture cost of the heating apparatus such as microwave ovens without any oven function where a temperature sensor to detect the internal temperature of the heating chamber is not necessary because any additional sensor for detecting the temperature of the background is not necessary.

Furthermore, in addition to the above features according to the present invention, the background temperature detection means calculates the temperature of the background based on the detection value of a temperature detection means additionally incorporated in the heating chamber. It is thereby possible to preciously detect the temperature of the background by utilizing the temperature sensor which is always incorporated in the heating chamber in oven-ranges in addition to the IR detection means.

Moreover, in addition to the above features according to the present invention, the background temperature detection means specifies one or more detection elements in the IR detection means in order to detect the temperature of the detection area other than the tray on which the target food is placed in the heating chamber, and preciously calculates the temperature of the background based on the detection results of the specified detection elements. It is thereby possible to detect the temperature of the background preciously.

Furthermore, in addition to the above features according to the present invention, the background temperature detection means calculates the temperature of the background based on the maximum value in the values detected in the most outer peripheral of the tray on which the target food is placed by the plural detection elements in the IR detection means. Thereby, it is possible to detect the temperature of the background preciously.

Moreover, in addition to the above features according to the present invention, the background temperature detection means preciously calculates the temperature of the background based on the temperature value of the heating chamber detected by the temperature detection means incorporated in the heating chamber when the door of the heating chamber is open. Thereby, it is possible to use the temperature value in the heating chamber detected by the temperature detection means before the target food is placed into the heating chamber.

Furthermore, in addition to the above features according to the present invention, the temperature calculation means calculates the initial temperature distribution in the heating chamber and estimates the initial temperature of the target food based on the minimum temperature value in the calculated temperature values in the initial temperature distribution. Thereby, it is possible to determine the initial temperature of the target food (luring the thawing process.

Moreover, in addition to the above features according to the present invention, the heating apparatus for cooking incorporates the boundary detection field judgment means to judge the detection field as the boundary detection field whose detected temperature is equal to an intermediate value between the calculated temperature value of the target food and the calculated temperature value of the background according to the initial temperature distribution calculated by the temperature calculation means. It is thereby possible to correctly judge the boundary detection field including both a part of the target food and the background.

Furthermore, in addition to the above features according to the present invention, the heating apparatus for cooking further comprises detection ratio judgment means for judging a ratio or a range of the target food in the boundary detection field where both the part of the target food and the background are detected simultaneously based on the calculated temperature of the target food and the calculated background temperature and the initial temperature distribution of the heating chamber obtained by the temperature calculation means. Thereby, the heating apparatus for cooking is capable of preciously determines the ratio of the target food in the boundary detection areas.

Moreover, in addition to the above features according to the present invention, the detection rate judgment means performs the temperature detection and the judgment operation many times. Thereby, it is possible to distinguish the target food from the tray which is rapidly heated when the target food on the tray is placed in the healing chamber and to determine the ratio of the target food in the boundary detection field preciously and also to calculate the temperature of the target food in the boundary detection field.

Furthermore, in addition to the above features according to the present invention, the heating apparatus for cooking further comprises the boundary target food temperature calculation means for compensating the calculated temperature of the boundary detection field where the target food and the background are detected simultaneously based on the judgment result of the detection rate judgment means, and calculates the temperature of the target food in the boundary detection field. Thereby, it is possible to preciously detect the end part of the target food in i:he boundary detection field.

Moreover, in addition to the above features according to the present invention, the heating process control means judges a rank of the ratio or the range of the target food in the boundary detection area, where both the target food and the background are detected simultaneously, obtained by the detection rate judgment means. The rank is selected in a plurality of ranks that are classified and set in advance corresponding to different heating processes. The heating process is performed according to the heating control manner that corresponds to the rank previously set. Thereby, it is possible to reduce the size of the memory for storing a heating control program and to increase the operation speed of the heating apparatus for cooking.

Furthermore, in addition to the above features according to the present invention, the heating process control means prohibits to perform a natural thawing process or outputs a warning when the internal temperature of the heating chamber is not less than a predetermined temperature value. Thereby, it is possible to preciously perform the heating control by detecting the temperature within the detectable range of an IR sensor when the IR sensor is used as the IR detection means.

Moreover, in addition to the above features according to the present invention, :he heating process control means provides a low heating power that is lower than a normal power of the natural thawing process when the internal temperature of the heating chamber is not less than a predetermined temperature value. It is possible to prevent any occurrence of the over-heating where the normal heating is performed when the initial temperature of the target food is high, and to perform the thawing process properly.

Furthermore, in addition to the above features according to the present invention, the heating process control means controls so that the heating means forcedly heats the target food until a maximum value or a minimum value in the parts in the target food or a value obtained by multiplying the maximum value or the minimum value with a desired ratio is reached to a predetermined value at which the part of the target state is fallen into a boiled state, and then decrease the heating power. Thereby, it is possible to perform the thawing process efficiently and to prevent any occurrence of a partial boiled state in the target food.

Moreover, in addition to the above features according to the present invention, the heating process control means sets a temperature value or a desired temperature range, that is lower than a temperature value at which a boiled state of the target food occurs, during at least one cooking-time period in a thawing process, and controls so that the heating means heats the target food at a constant temperature so that a maximum value or a minimum value in the parts in the target food or a value obtained by multiplying the maximum value or the minimum value with a desired ratio is reached to a predetermined value or a predetermined range. Thereby, it is possible to thaw each part in the target food uniformly.

Furthermore, in addition to the above features according to the present invention, the heating process control means sets a plurality of temperature values or a plurality of temperature ranges, that are lower than a temperature value at which a boiled state of the target food occurs, during at least one cooking-time period in a thawing process, and controls so that the heating means heats the target food at a constant temperature during a desired time period E;o that a maximum value or a minimum value in the parts in the target food or a value obtained by multiplying the maximum value or the minimum value with a desired ratio is reached to a predetermined temperature value or within a predetermined temperature range. Thereby, it is possible to thaw the entire target food including the internal part thereof uniformly until the temperature of the target food is reached near the thawing completion temperature.

Moreover, in addition to the above features according to the present invention, the heating process control means controls the power of the heating means so that a difference between the maximum temperature value and the minimum temperature value in the parts of the target food to be detected is within a desired value. Thereby, it is possible to thaw the target food so that each part of the target food has a uniform temperature.

Furthermore, in addition to the above features according to the present invention, the heating process control means halts the heating operation by the heating means until the temperature difference is not more than a desired value when a difference between the maximum temperature value and the minimum temperature value in the temperatures of the parts in the target food to be detected is not less than a desired value. Thereby, it is possible to thaw the target food so that each part of the target food has a uniform temperature.

Moreover, in addition to the above features according to the present invention, the heating apparatus for cooking further comprises initial temperature detection means for detecting an initial temperature of the target food. The heating process control means performs a thawing process based on a different heating control manner corresponding to the initial temperature of the target food detected by the initial temperature detection means. Thereby, it is possible to control the thawing and heating process properly according to the initial temperature of the target food, to perform the rapid thawing when the target food is a frozen food of a very low temperature and to perform a moderate thawing process in order to prevent any occurrence of a half-boiled state when the initial temperature of the target food is approximately 0° C.

Furthermore, in addition to the above features according to the present invention, the heating process control means stops the heating process or outputs a warning without performing any thawing process in order to finish the cooking process when the initial temperature of the target food detected by the initial temperature detection means is not less than a predetermined value. Thereby, it is possible to prevent the execution of unnecessary thawing.

Moreover, in addition to the above features according to the present invention, the heating process control means stops the heating process by the heating means when a maximum value in a calculated temperature value in the direct detection area, where only the target food is detected, and a calculated temperature value of a part in the target food in the boundary detection area, where both the part of the target food and the background are detected simultaneously, is reached to a set temperature value. Thereby, it is possible to prevent any occurrence of the boiled state of the target food that often occurs at the end part of the target food and to perform the appropriate thawing process.

Furthermore, in addition to the above features according to the present invention, the heating process control means stops the heating process by the heating means when a minimum value in a calculated temperature value in the direct detection area, where only the target food is detected, and a calculated temperature value of a part in the target food in the boundary detection area, where both the part of the target food and the background are detected simultaneously, is reached to a set temperature value. Thereby, it is possible to thaw the target food entirely while preventing any occurrence of the boiled state.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention, which is defined by the appended claims.

What is claimed is:

1. A heating apparatus for cooking comprising:

a heating chamber in which a target food to be cooked is placed and then heated;

heating means for irradiating a microwave on the target food;

infrared ray (IR) detection means comprising a plurality of detection elements for detecting a plurality of detection areas in the heating chamber by a non-contact manner;

temperature calculation means for calculating temperatures of the plurality of detection areas based on the detection results obtained by the IR detection means;

heating process control means for controlling a heating process for the target food based on calculation results obtained by the temperature calculation means; and detection target judgment means for judging a type of each detection area in the heating chamber corresponding to each of the plurality of detection elements based on a detected initial temperature distribution of the heating chamber, wherein the type of the detection area is one of three types, a direct detection area where there is only a part or entire of the target food and the target food is directly detected, a boundary detection area where there are both a part or entire of the target food and a background simultaneously, and a background area where there is no target food, wherein the heating process control means controls the heating process based on the detection results obtained by the detection target judgment means.

2. A heating apparatus for cooking according to claim 1, further comprises:

background temperature detection means for detecting a temperature of the background in the heating chamber during the cooking of the target food; and temperature calculation means for the target food for calculating a calculation temperature of the target food based on temperatures detected in the direct detection area where only the target food is directly detected and for calculating a calculation temperature of each part in the target food in the boundary detection field where both the part of the target food and the background are detected simultaneously.

3. A heating apparatus for cooking according to claim 2, wherein the background temperature detection means calculates the temperature of the background based on a detection result obtained by a self-temperature detection means for detecting a self-temperature incorporated in the IR detection means.

4. A heating apparatus for cooking according to claim 2, wherein the background temperature detection means calculates the temperature of the background based on a detection result of a temperature detection means for detecting an internal temperature of the heating chamber that is additionally incorporated in the heating chamber.

5. A heating apparatus for cooking according to claim 4, wherein the background temperature detection means calculates the temperature of the background based on a detected internal temperature value of the heating chamber detected by the temperature detection means for detecting the internal temperature of the heating chamber when a door of the heating chamber is open.

6. A heating apparatus for cooking according to claim 4, wherein the temperature calculation means calculates an initial temperature distribution of the heating chamber and calculates an initial temperature of the target food based on a minimum temperature value in the initial temperature distribution in the heating chamber.

7. A heating apparatus for cooking according to claim 2, wherein the background temperature detection means sets one or more of the plurality of detection elements in the IR detection means as an element for detecting a temperature of an area other than a tray on which the target food is placed in the heating chamber, and calculates the temperature of the background based on the temperature obtained by the one or more of the plurality of detection elements.

8. A heating apparatus for cooking according to claim 2, wherein the background temperature detection means calculates the temperature of the background based on the maximum value in the temperature values detected at the most outer periphery of a tray, on which the target food is placed, in the detection ranges in the heating chamber detected by the plurality of detection elements.

9. A heating apparatus for cooking according to claim 1, further comprises boundary detection area judgment means for judging the boundary detection area based on an intermediate value between the calculated temperature of the target food and the calculated temperature of the background according to the initial temperature distribution in the heating chamber calculated by the temperature calculation means.

10. A heating apparatus for cooking according to claim 1, further comprises detection rate judgment means for judging a ratio or a range of the target food in the boundary detection area, where both the target food and the background are detected simultaneously, based on the calculated temperature of the target food, the calculated temperature of the background, and the initial temperature distribution in the heating chamber calculated by the temperature calculation means.

11. A heating apparatus for cooking according to claim 10, wherein the detection rate judgment means performs the temperature detection and judgment operation plural times.

12. A heating apparatus for cooking according to claim 10, further comprises boundary target food temperature calculation means for compensating the calculated temperature value in a boundary detection area where both the target food and the background are detected simultaneously based on the judgment result of the detection rate judgment means, and for calculating the temperature of a part in the target food in the boundary detection area.

13. A heating apparatus for cooking according to claim 10, wherein the heating process control means judges a rank of the ratio or the range of 1:he target food in the boundary detection area, where both the target food and the background are detected simultaneously, obtained by the detection rate judgment means, and wherein the rank is selected in a plurality of ranks that are classified and set in advance corresponding to different heating processes.

14. A heating apparatus for cooking according to claim 1, wherein the heating process control means prohibits to perform a natural thawing process or outputs a warning when the internal temperature of the heating chamber is not less than a predetermined temperature value.

15. A heating apparatus for cooking according to claim 1, wherein the heating process control means provides a low heating power that is lower than a normal power of the natural thawing process when the internal temperature of the heating chamber is not less than a predetermined temperature value.

16. A heating apparatus for cooking according to claim 1, wherein the heating process control means controls so that the heating means forcedly heats the target food until a maximum value or a minimum value in the parts in the target food or a value obtained by multiplying the maximum value or the minimum value with a desired ratio is reached to a predetermined value at which the part of the target state is fallen into a boiled state, and then decrease the heating power.

17. A heating apparatus for cooking according to claim 1, wherein the heating process control means sets a temperature value or a desired temperature range, that is lower than a temperature value at which a boiled state of the target food occurs, during at least one cooking-time period in a thawing process, and controls so that the heating means heats the target food at a constant temperature so that a maximum value or a minimum value in the parts in the target food or a value obtained by multiplying the maximum value or the minimum value with a desired ratio is reached to a predetermined temperature value or within a predetermined temperature range.

18. A heating apparatus for cooking according to claim 1, wherein the heating process control means sets a plurality of temperature values or a plurality of temperature ranges, that are lower than a temperature value at which a boiled state of the target food occurs, during at least one cooking-time period in a thawing process, and controls so that the heating means heats the target food at a constant temperature during a desired time period so that a maximum value or a minimum value in the parts in the target food or a value obtained by multiplying the maximum value or the minimum value with a desired ratio is reached to a predetermined temperature value or within a predetermined temperature range.

19. A heating apparatus for cooking according to claim 1, wherein the heating process control means controls the power of the heating means so that a difference between the maximum temperature value and the minimum temperature value in the parts of the target food to be detected is within a desired value.

20. A heating apparatus for cooking according to claim 1, wherein the heating process control means halts the heating operation by the heating means until the temperature difference is not more than a desired value when a difference between the maximum temperature value and the minimum temperature value in the temperatures of the parts in the target food to be detected is not less than a desired value.

21. A heating apparatus for cooking according to claim 1, further comprises initial temperature detection means for detecting an initial temperature of the target food, wherein the heating process control means performs a thawing process based on a different heating control manner corresponding to the initial temperature of the target food detected by the initial temperature detection means.

22. A heating apparatus for cooking according to claim 21, wherein the heating process control means stops the heating process or outputs a warning without performing any thawing process in order to finish the cooking process when the initial temperature of the target food detected by the initial temperature detection means is not less than a predetermined value.

23. A heating apparatus for cooking according to claim 1, wherein the heating process control means stops the heating process by the heating means when a maximum value in a calculated temperature value in the direct detection area, where only the target food is detected, and a calculated temperature value of a part in the target food in the boundary detection area, where both the part of the target food and the background are detected simultaneously, is reached to a set temperature value.

24. A heating apparatus for cooking according to claim 23, wherein the heating process control means stops the heating process by the heating means when a minimum value in a calculated temperature value in the direct detection area, where only the target food is detected, and a calculated temperature value of a part in the target food in the boundary detection area, where both the part of the target food and the background are detected simultaneously, is reached to a set temperature value.

* * * * *